US011338298B2

(12) United States Patent
Verzilli et al.

(10) Patent No.: US 11,338,298 B2
(45) Date of Patent: May 24, 2022

(54) MATERIAL REDUCING APPARATUS HAVING A SYSTEM FOR ALLOWING A REDUCING ROTOR TO BE SELECTIVELY CONFIGURED IN MULTIPLE DIFFERENT REDUCING CONFIGURATIONS

(71) Applicant: Vermeer Manufacturing Company, Pella, IA (US)

(72) Inventors: Claudio Carrafiello Verzilli, Pella, IA (US); Clark David Carpenter, Barnes City, IA (US)

(73) Assignee: Vermeer Manufacturing Company, Pella, IA (US)

( * ) Notice: Subject to any disclaimer, the term of this patent is extended or adjusted under 35 U.S.C. 154(b) by 224 days.

(21) Appl. No.: 16/685,214

(22) Filed: Nov. 15, 2019

(65) Prior Publication Data

US 2020/0197947 A1 Jun. 25, 2020

Related U.S. Application Data

(60) Provisional application No. 62/782,717, filed on Dec. 28, 2018.

(51) Int. Cl.
*B02C 13/06* (2006.01)
*B02C 13/28* (2006.01)

(52) U.S. Cl.
CPC ..... *B02C 13/2804* (2013.01); *B02C 13/06* (2013.01)

(58) Field of Classification Search
CPC ..... B02C 13/06; B02C 13/2804; B02C 2013/2812; B02C 18/18; B02C 18/145
See application file for complete search history.

(56) References Cited

U.S. PATENT DOCUMENTS

| | | | |
|---|---|---|---|
| 4,082,232 | A | 4/1978 | Brewer |
| 5,165,611 | A | 11/1992 | Ragnarsson |
| 6,422,495 | B1 | 7/2002 | De Boef et al. |
| 6,840,471 | B2 | 1/2005 | Roozeboom et al. |
| 7,204,442 | B2 | 4/2007 | Roozeboom et al. |
| 7,213,779 | B2 | 5/2007 | Roozeboom et al. |

(Continued)

FOREIGN PATENT DOCUMENTS

| | | | |
|---|---|---|---|
| CN | 201603593 | U | 10/2010 |
| DE | 102006047406 | A1 | 4/2008 |

OTHER PUBLICATIONS

European Patent Office Extended Search Report for Application No. 19165263.5 dated Oct. 11, 2019 (6 pages).

(Continued)

*Primary Examiner* — Faye Francis
(74) *Attorney, Agent, or Firm* — Michael Best & Friedrich LLP

(57) ABSTRACT

The present disclosure relates to a system for a material reducing machine that allows a reducing rotor to be selectively configurable in a plurality of different reducing configurations. The different reducing configurations in which the reducing rotor can be configured can include reducing configurations having reducers located at different positions, reducing configurations having different reducer densities (e.g., different overall densities and different regionalized densities), reducer configurations having different reducer counts, reducer configurations having different reducer patterns, and reducer configurations having different lay-outs.

19 Claims, 21 Drawing Sheets

(56) References Cited

U.S. PATENT DOCUMENTS

| | | | | |
|---|---|---|---|---|
| 7,448,567 | B2 * | 11/2008 | Roozeboom | B02C 13/06 241/191 |
| 7,959,097 | B2 | 6/2011 | De Boef | |
| 7,959,099 | B1 * | 6/2011 | Cox | B02C 18/145 241/294 |
| 8,061,640 | B2 * | 11/2011 | Cotter | B02C 13/06 241/101.01 |
| 8,066,213 | B2 * | 11/2011 | Marquardsen | B02C 13/06 241/242 |
| 8,844,853 | B2 * | 9/2014 | Hongo | B02C 13/284 241/294 |
| 9,021,679 | B2 | 5/2015 | Roozeboom | |
| 9,675,976 | B2 | 6/2017 | Roozeboom et al. | |
| 2010/0206973 | A1 * | 8/2010 | Cotter | B02C 13/2804 241/192 |
| 2012/0043403 | A1 * | 2/2012 | Roozeboom | B02C 21/026 241/25 |
| 2014/0217220 | A1 | 8/2014 | Weinberg | |

OTHER PUBLICATIONS

KOMPTECH Americas, "High Torque Shredders: Terminator and Crambo", Informational Brochure, 2018, 6 pages.

Office Action issued from the Chinese Patent office for related Application No. 201911298798.1 dated Jan. 10, 2022 (13 pages with english translation).

* cited by examiner

MATERIAL REDUCING APPARATUS HAVING A SYSTEM FOR ALLOWING A REDUCING ROTOR TO BE SELECTIVELY CONFIGURED IN MULTIPLE DIFFERENT REDUCING CONFIGURATIONS

RELATED APPLICATIONS

This application claims the benefit of U.S. Provisional Patent Application No. 62/782,717 filed on Dec. 20, 2018, the entire content of which is hereby incorporated by reference herein.

TECHNICAL FIELD

The present disclosure relates to material reducing machines such as grinders, shredders and chippers.

BACKGROUND

Material reducing machines are used to reduce the size of material such as waste material. Example waste materials include waste wood (e.g., trees, brush, stumps, pallets, railroad ties, etc.) peat moss, paper, wet organic materials, industrial waste, garbage, construction waste and the like. A typical material reducing machine such as a grinder, a chipper or a shredder includes a rotor to which a plurality of reducers (e.g., teeth, cutters, blades, grinding tips, chisels, etc.) are mounted. The reducers are typically mounted about the circumference of the rotor and are carried with the rotor about an axis of rotation of the rotor as the rotor is rotated. During reducing operations, the rotor is rotated and waste material is fed adjacent to the rotor such that contact between the reducers and the waste material provides a reducing or commutating action with respect to the waste material.

Grinders and chippers typically are configured to reduce material through direct impaction of the reducers against the material. In contrast, shredders are commonly configured such that the reducers operate in cooperation with a comb structure which intermeshes with the reducers as the rotor rotates. In operation of a typical shredder, material fed into the shredder is forced through the comb structure by the reducers as the rotor rotates thereby providing a shredding action. It will be appreciated that during reducing operations, the rotors of grinders and chippers typically operate at higher rotational speeds that the rotors of shredders.

Rotors having different types of reducing configurations can be used to process different types of materials and to yield reduced product having different material properties. To modify the reducing configuration of the rotor of a given material reducing machine, it is typically required to replace a rotor having a first reducing configuration with another rotor having a second reducing configuration. Thus, rotor substitution is typically required which can be time consuming and expensive since multiple rotors are required to be made available. U.S. Pat. No. 9,021,679 discloses a material reducing machine having a rotor that can be altered between a chipping configuration and a grinding configuration. This is accomplished by interchanging different styles of reducers (e.g., chipping reducers vs. grinding reducers). However, in both configurations, the reducing elements are arranged in the same positions, and the rotor has the same reducer density and reducer pattern. There is a need for systems, methods and devices that enhance the ability to efficiently provide different reducer densities, different reducer patterns, different reducer counts, different reducer positioning schemes, and different reducer lay-outs for a given rotor.

SUMMARY

Certain examples of the present disclosure relate to systems, methods and devices configured to allow a reducing rotor to selectively be configured in one of a plurality of different reducing configurations. In one example, the different reducing configurations in which the reducing rotor can be configured can include reducing configurations having reducers located at different positions, reducing configurations having different reducer densities (e.g., different overall densities and different regionalized densities), reducer configurations having different reducer counts, reducer configurations having different reducer patterns, and reducer configurations having different lay-outs.

Another example of the present disclosure relates to a material reducing apparatus including a rotor and a plurality of different styles of hammers that are mountable to the rotor. The different styles of hammers can include single-reducer hammers and double-reducer hammers that are interchangeably mountable to the rotor. In another example, the material reducing machine can further include double-blank components that are interchangeably mountable to the rotor along with the single-reducer hammers and the double-reducer hammers. By selectively installing different styles of hammers or other components at different hammer mounting locations of the rotor, the rotor can be configured in different rotor configurations having different reducer densities, different reducer patterns and different reducer counts. Further, different regions of the rotor can be provided with higher and/or lower densities of reducers as compared to other regions of the rotor.

Another example of the present disclosure relates to a material reducing system including a rotor that in use is rotated about a central axis. The rotor includes a plurality of hammer receivers. The material reducing system also includes interchangeable hammers that are removably mountable to the rotor. The interchangeable hammers include double-reducer hammers and single-reducer hammers. Two of the hammer receivers cooperate to mount each of the single-reducer and double-reducer hammers to the rotor. The interchangeable single-reducer and double-reducer hammers allow the rotor to be configured in different reducing configurations.

Another example of the present disclosure relates to a material reducing system including a rotor that in use is rotated about a central axis. The rotor includes a plurality of hammer receivers. The material reducing system also includes single-reducer hammers that are removably mountable to the rotor. When the single-reducer hammers are mounted to the rotor, two of the hammer receivers cooperate to mount each of the single-reducer hammers to the rotor. Each of the single-reducer hammers includes a blank end and an opposite reducing end. When the single-reducer hammers are mounted to the rotor; a) the blank ends are received within first ones of the hammer receivers; b) the reducer ends are received within second ones of the hammer receivers; c) the blank ends define blank locations at the first ones of the hammer receivers; and d) the reducing ends project outwardly from the rotor and define reducer locations at the second ones of the hammer receivers.

Another example of the present disclosure relates to a material reducing machine having a reducing rotor having a plurality of component mounting locations positioned at a periphery of the rotor. A plurality of different components are interchangeably and removeably mountable at each of the component mounting locations of the rotor. The components can include reducer components and blank components. By selectively using either reducer components or blank components at the various component mounting locations, different reducer densities, reducer patterns and reducer counts can be provided on the rotor. It will be appreciated that by increasing the number of blanks components used as compared to reducer components, the reducer density of the rotor will decrease. In contrast, by reducing the number of blanks used as compared to reducer components, the reducer density of the rotor will increase. Additionally, the reducer densities can be varied at different regions along the length of the rotor.

Another example of the present disclosure relates to a material reducing system including a rotor that in use is rotated about a central axis. The rotor includes a plurality of component mounting locations. The material reducing system also includes a plurality of components that are removeably mountable at the component mounting locations and are configured for defining blank locations at an exterior of the rotor when mounted at the component mounting locations and/or are configured for defining reducer locations at the exterior of the rotor when mounted at the component mounting location. The components include: a) single-reducer hammers each including a reducing end and an opposite blank end, wherein when each of the single-reducer hammer is mounted to the rotor at one of the component mounting locations the reducing end defines one of the reducer locations at the exterior of the rotor and the blank end defines one of the blank locations at the exterior of the rotor; or b) separate reducing components and blank components that are interchangeably mountable at the component mounting locations, the reducing components each defining one of the reducer locations at the exterior of the rotor when mounted at one of the component mounting locations, and the blank components each defining one of the blank locations at the exterior of the rotor when mounted at one of the component mounting locations.

A variety of advantages of the disclosure will be set forth in part in the description that follows, and in part will be apparent from the description, or may be learned by practicing the various aspects and examples of the present disclosure. It is to be understood that both the forgoing general description and the following detailed description are exemplary and explanatory only and are not restrictive of the broad inventive concepts upon which the examples and aspects are based.

DETAILED DESCRIPTION

The present disclosure relates to material reducing systems in accordance with the principles of the present disclosure that readily allow a reducing rotor be arranged in different reducing configurations. The material reducing system allows an operator to select between a plurality of different reducing configurations when initially populating the rotor (e.g., at least 3 reducing configurations, or at least 4 reducing configurations, or at least 5 reducing configurations). Additionally, the material reducing system allows an operator to modify a reducing configuration of the rotor as needed after initial population (e.g., reducing configuration modifications can be made without requiring the rotor to be removed from the reducing machine and without requiring substitution of different rotors).

In certain examples, to enhance configurability and/or re-configurability, mounting locations (e.g., hammer receivers) of the rotor can be selectively populated (e.g., filled) with a reducer or can be selectively populated with a blank. In certain examples, different types of reducers and/or blanks can be interchanged on the rotor while the rotor remains mounted in the reducing machine.

In certain examples, the rotor can be used in combination with single-reducer hammers that each include a blank and at an opposite reducing end. In certain examples, the rotor can be used in combination with double-reducer hammers which each include two oppositely positioned reducing ends. In still other examples, the rotor can be used in combination with double-ended blank components.

Figure 1:
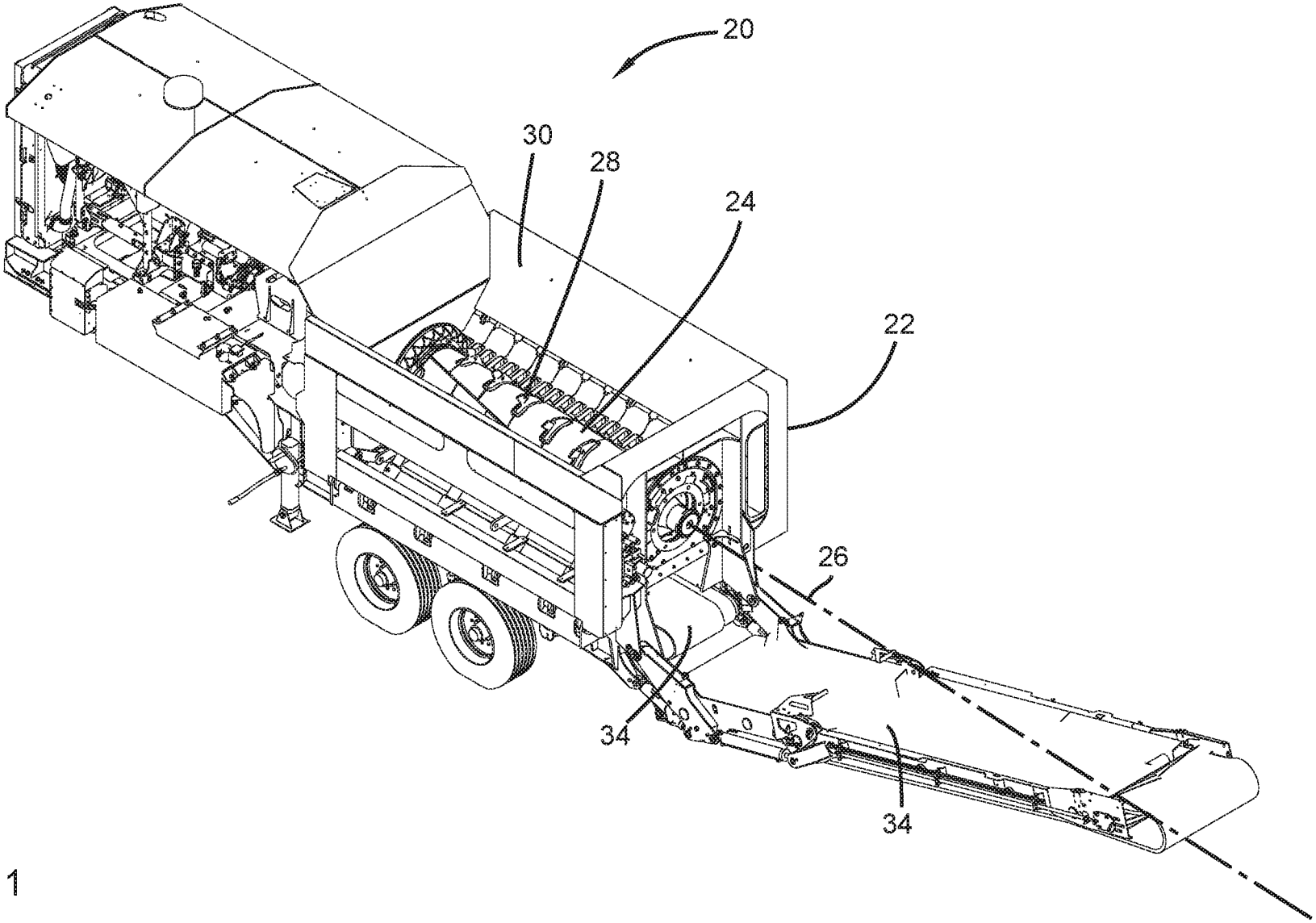
FIG. 1 depicts a material reducing machine that is an example of one type of material reducing machine in which a rotor system in accordance with the principles of the present disclosure can be utilized.
Figure 2:
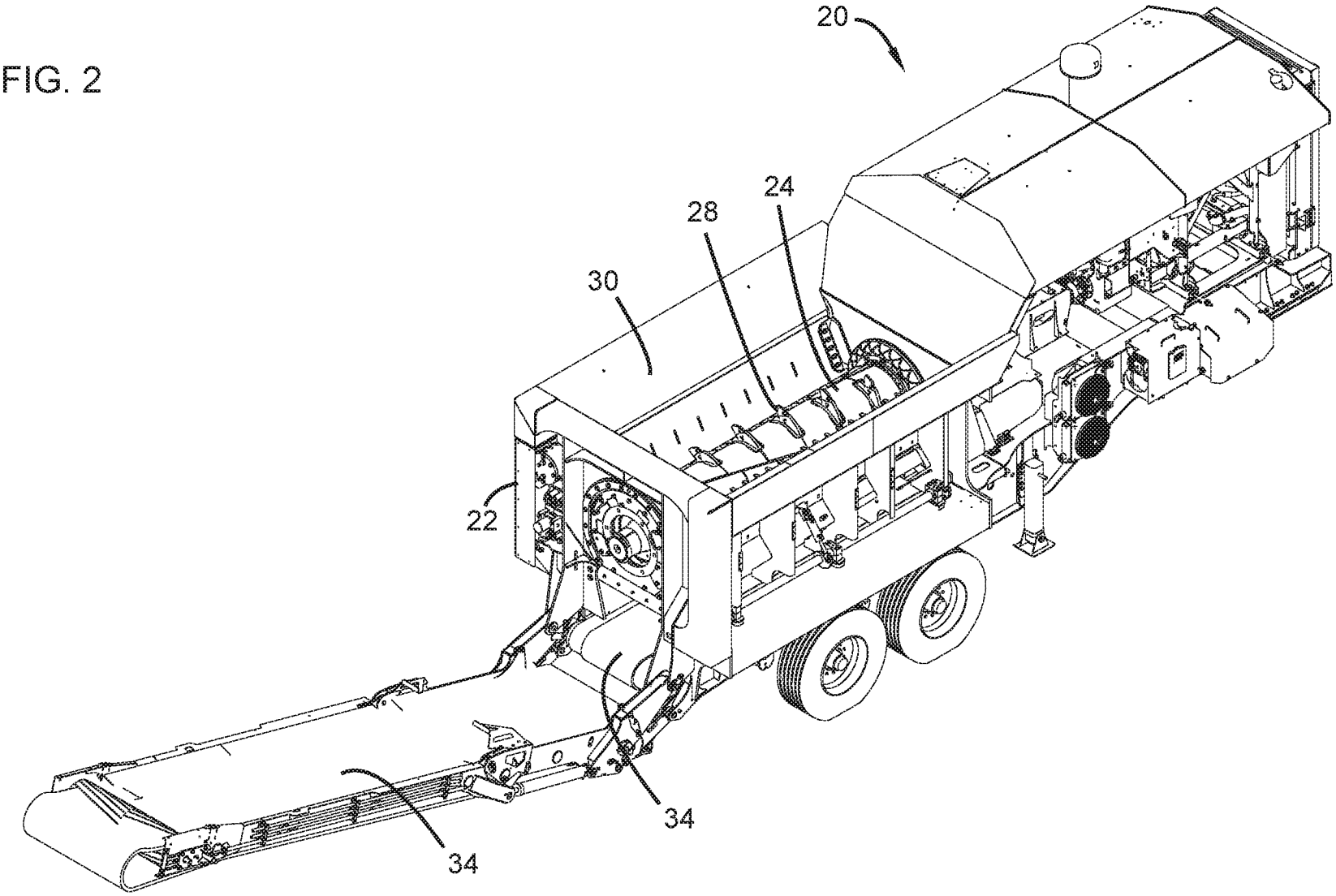
FIG. 2 is another view of the material reducing machine of FIG. 1.
Figure 3:
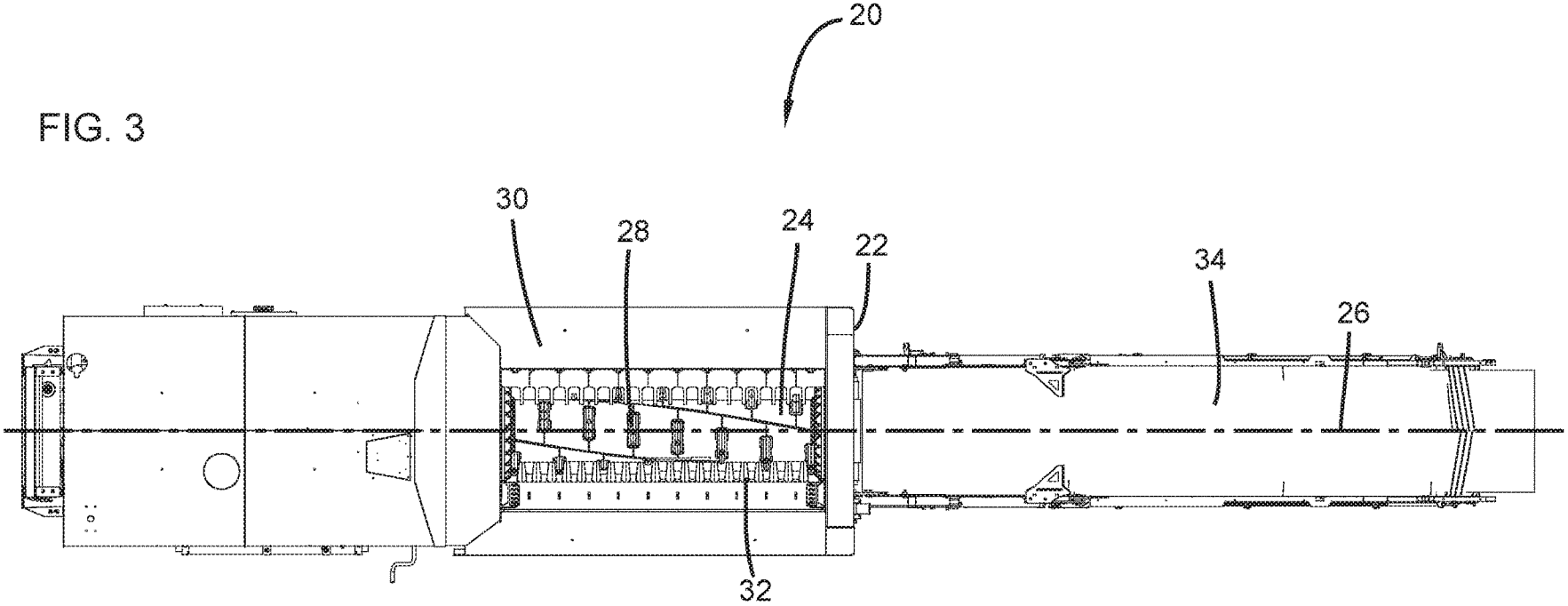
FIG. 3 is a transverse cross-sectional view of the material reducing machine of FIGS. 1 and 2.

FIGS. 1-3 depict an example material reducing machine 20 that is one example of a type of material reducing machine in which material reducing systems in accordance with the principles of the present disclosure can be incorporated. The material reducing machine 20 is depicted as a shredder, but it will be appreciated that aspects of the present disclosure are also applicable to other types of material reducing machines such as grinders and chippers. In one optional example, the material reducing machine 20 can be a relatively slow-speed shredder at which the rotor is operated at speeds less than or equal to 40 rotations per minute during shredding operations. It will be appreciated that slower operating rotor speeds decrease the importance of maintaining rotor balance and therefore allow for more flexibility in selecting different reducing rotor configurations.

The material reducing machine 20 of FIGS. 1-3 include a main framework defining a reducing box 22 in which a reducing rotor 24 is positioned. The reducing rotor 24 is mounted to rotate within the reducing box 22 about a central axis (e.g., the rotor 24 can be rotationally mounted to the reducing box 22 via bearings). A plurality of reducers 28 are mounted at an exterior of the rotor 24. When the rotor 24 is rotated about the central axis 26, the reducers 28 are carried by the rotor 24 along circular reducing paths that surround the central axis 26. The reducing machine includes a hopper 30 above the reducing rotor 24 for allowing material desired to be reduced to be fed into the reducing box 22, and optionally includes a screen that mounts below the reducing rotor 24 for controlling the size of the reduced product which is output from the reducing box 22. The material reducing machine 20 further includes a shredding comb 32 mounted within the reducing box 22. The shredding comb 32 includes a plurality of comb teeth and the shredding comb 32 is positioned relative to the rotor 24 such that the reducers 28 intermesh with the comb teeth as the rotor is rotated about the central axis 26. In other words, as the rotor 24 is rotates, the reducers 28 pass between corresponding ones of the comb teeth of the shredding comb 32. The material reducing machine 20 also includes a powertrain for driving rotation of the rotor 24 about the central axis 26. The powertrain can include a prime mover (e.g., an engine) that provides the power required to drive rotation of the rotor 24. The powertrain can also include a transmission for transferring the power from the prime mover to the rotor. The power can be transferred in the form of torque. The material reducing machine 20 can also include one or more conveyors 34 for transferring reduced product discharged from the reducing box 22 away from the reducing box 22.

In operation of the material reducing machine 20, material desired to be reduced is fed into the reducing box 22 through the hopper 30. Within the reducing box 22, the rotor 24 is rotated about the axis 26 by the powertrain. The material fed into the reducing box 22 is impacted by the reducers 28 of the rotating rotor 24 and is forced by the reducers 28 through the shredding comb 32 thereby causing the material to be reduced in size via shredding. The shredded material forced through the comb 32 can be deposited on the conveyor and transferred by the conveyor 34 to a collection location such as a truck bed or a pile on the ground. If a sizing screen is present below the rotor 24, material that has been reduced to a size small enough to pass through the screen is deposited on the conveyor 34 while the remainder of the material is recirculated by the rotor 24 back into the reducing box 22 for further processing.

FIGS. 4-15 disclose a material reducing system 50 that can be integrated into a material reducing machine such as the material reducing machine 20. The material reducing system 50 includes a rotor 52. The rotor 52 is mountable in a material reducing machine (e.g., in the reducing box 22 of the reducing machine 20) and when mounted in the reducing machine is adapted for rotation about a central axis of rotation 54. In use, the rotor 52 can be rotationally driven by a source of torque (e.g., a powertrain) so as to rotate about the central axis of rotation 54.

The rotor 52 includes a plurality of component mounting locations 53. In the depicted example, the component mounting locations can include hammer receivers 56. In certain examples, hammer receivers 56 can include pockets, receptacles or like structures for receiving components such as reducing hammers, blanks or other components. In the depicted example, each component mounting location 53 includes a pair of hammer receivers **56*a*, 56*b* (i.e., sets of hammer receivers) positioned on diametrically opposite sides of the rotor 52. The pairs of hammer receivers 56*a*, 56*b* are connected by guide sleeves 58 that each extend through the rotor 52 between the hammer receivers 56*a*, 56*b***.

The component mounting locations 53 are depicted as being arranged a plurality of consecutive axial positions along the axial length of the rotor 52. In the depicted example, the rotor 52 optionally includes a cylindrical outer skin 60 through which the hammer receivers 56 are defined. The outer skin 60 defines an exterior of the rotor 52. The outer skin 60 also defines a cylindrical outer boundary of the rotor 52. In certain examples, the hammer receivers 56 of axially adjacent component mounting locations 53 along the axial length of the rotor 52 are circumferentially offset from one another in an orientation that extends about the axis of rotation 54. In one example, the hammer receivers **56*a* of axially adjacent component mounting locations 53 are circumferentially offset from one another by a repeating offset angle (e.g., 60 degrees about the circumference) and the hammer receivers 56*b* of axially adjacent component mounting locations 53** are circumferentially offset from one another by a repeating offset angle (e.g., 60 degrees about the circumference).

The hammer receivers **56*a*, 56*b* preferably are adapted for securing a component to the rotor 52. For example, each of the hammer receivers 56*a*, 56*b* can function as a securement or engagement location for coupling a corresponding portion of a component mounted therein to the rotor. Examples securement structure can include fasteners, clamps and the like. As depicted, each of the hammer receivers 56*a*, 56*b* includes a clamping arrangement 61 including one or more clamping wedges 62 actuated by a fastener 64 to clamp a component received therein in place relative to the rotor 52. Thus, a given component secured at one of the component mounting locations 53 is secured to the rotor 52 at two separate securement locations (e.g., clamping locations) positioned on opposite sides of the rotor 52. The separate securement locations correspond to the hammer receivers 56***a*, 56*b*. U.S. Pat. No. 9,675,976, which is hereby incorporated by reference in its entirety, provides further details about example component mounting locations, hammer receivers and clamping arrangements that may be used with the rotor 52.

The depicted example system of FIGS. 4-15 can include different components that are mountable to the rotor 52. The different components can include components. Examples of different reducing components include different types of hammers such as single-reducer hammers and double-reducer hammers. An example blank component is a double-blank component which forms two blank locations on the rotor when mounted at a given component mounting location. As shown at FIGS. 4-8, only one type of reducing component (e.g., single-reducer hammers) is mounted to the rotor 52. However, it will be appreciated that the depicted reducing components are removeably mounted at the component mounting locations 53, and that other types of components (e.g., double-reducer hammers, double-blank components) are preferably interchangeable with respect to the depicted reducing components to alter the reducing configuration of the rotor 52. The components can be loaded into and removed from the component mounting locations 53 while the rotor remains mounted in the reducing machine. Thus, it is not required to remove the rotor from the reducing machine to populate the rotor with components or to interchange components to switch between different reducing configurations. In certain examples, the components are slid into the component mounting locations 53, and then secured (e.g., clamped or fastened) in place relative to the rotor. In certain examples, the rotor can be rotated or indexed within the reducing machine to selectively bring the component mounting locations 53 into alignment with a location where the component mounting locations can be readily accessed (e.g., a side of the reducing machine having a swing-down wall that openings the side of the reducing machine to provide enhanced access to the rotor).

A single-reducer hammer is a hammer having only one end that is a reducing end and an opposite end that is a blank end. The reducing end can either itself form a reducer or reducers, or can provide an attachment location for attaching one or more reducers. When a single-reducer hammer is mounted at one of the component mounting locations 53, the blank end forms a blank location at one region of the component mounting location (e.g., at one side of the rotor 52 such as at one of the hammer receivers 56*a*, 56*b* of the given receiver pair) and the reducing end forms a reducer location at another region of the component mounting location (e.g., at an opposite side of the rotor such as at the other hammer receiver 56*a*, 56*b* of the given receiver pair). The blank location is preferably recessed or flush relative to the exterior of the rotor 52 while the reducer location preferably projects outwardly (e.g., in a radial direction relative to the central axis 54) beyond the exterior of the rotor 52.

Figure 9:
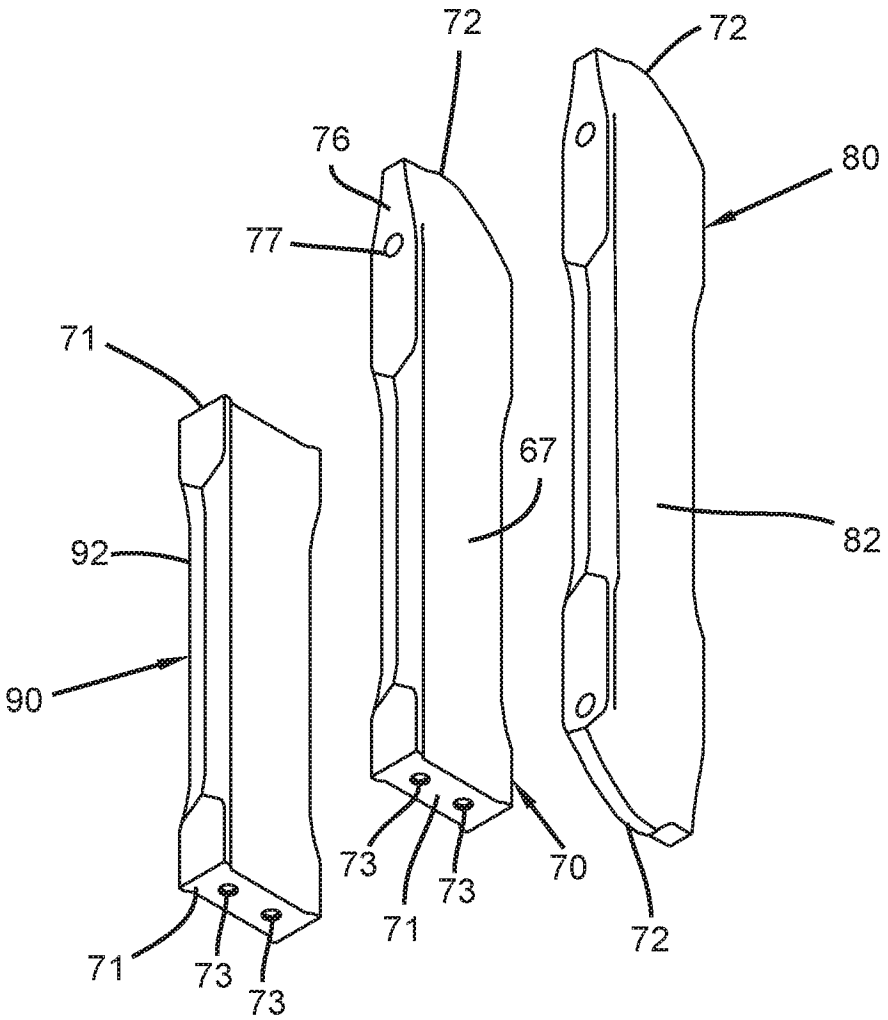
FIG. 9 is a perspective view showing three different types or styles of components that are interchangeably and removeably mountable to the reducer rotor system of FIGS. 4-8.
Figure 10:
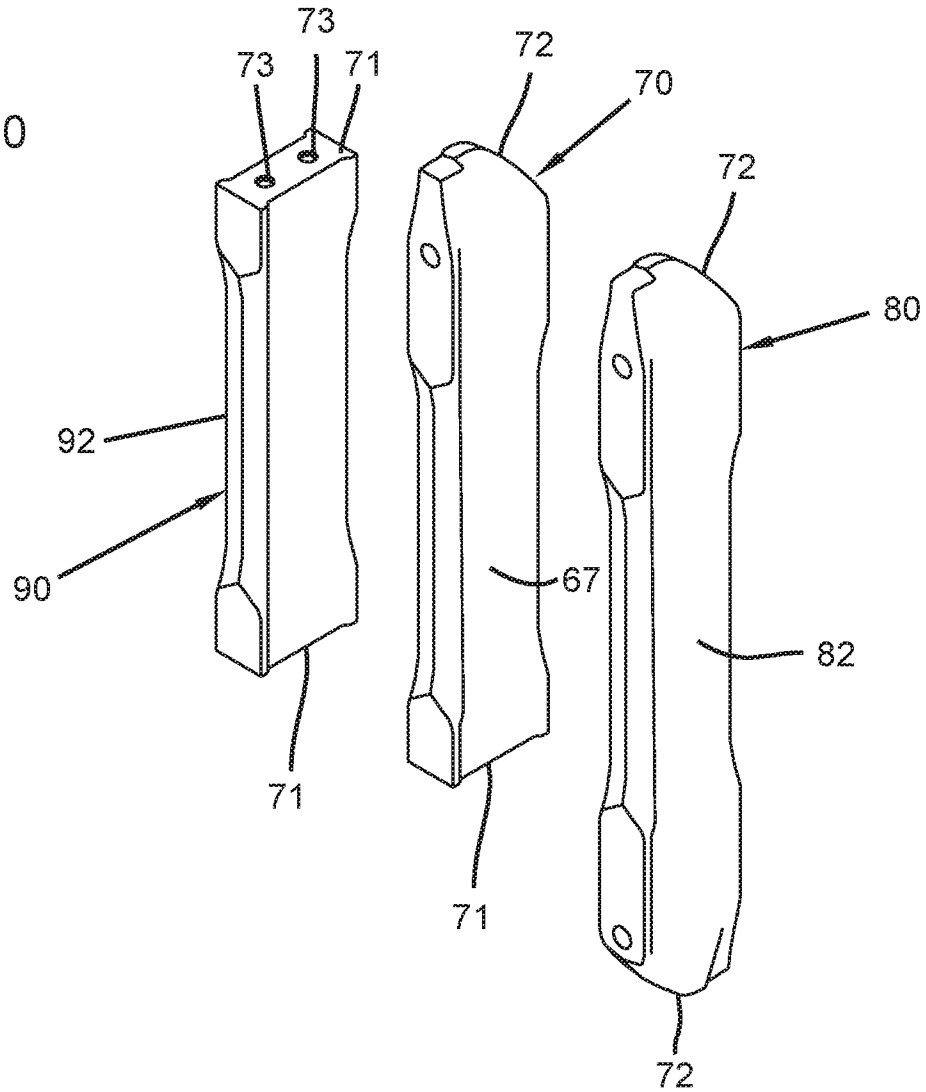
FIG. 10 is another view of the components of FIG. 9.
Figure 11:
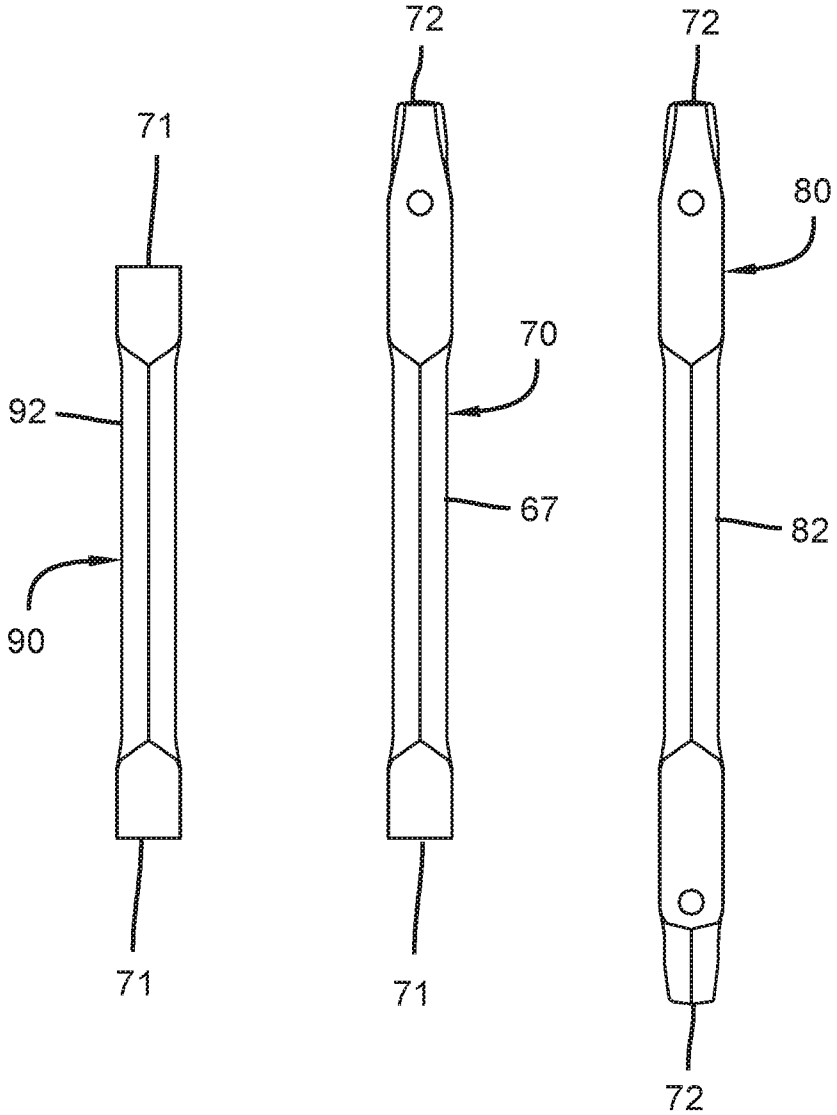
FIG. 11 is still another view of the components of FIG. 9.
Figure 12:
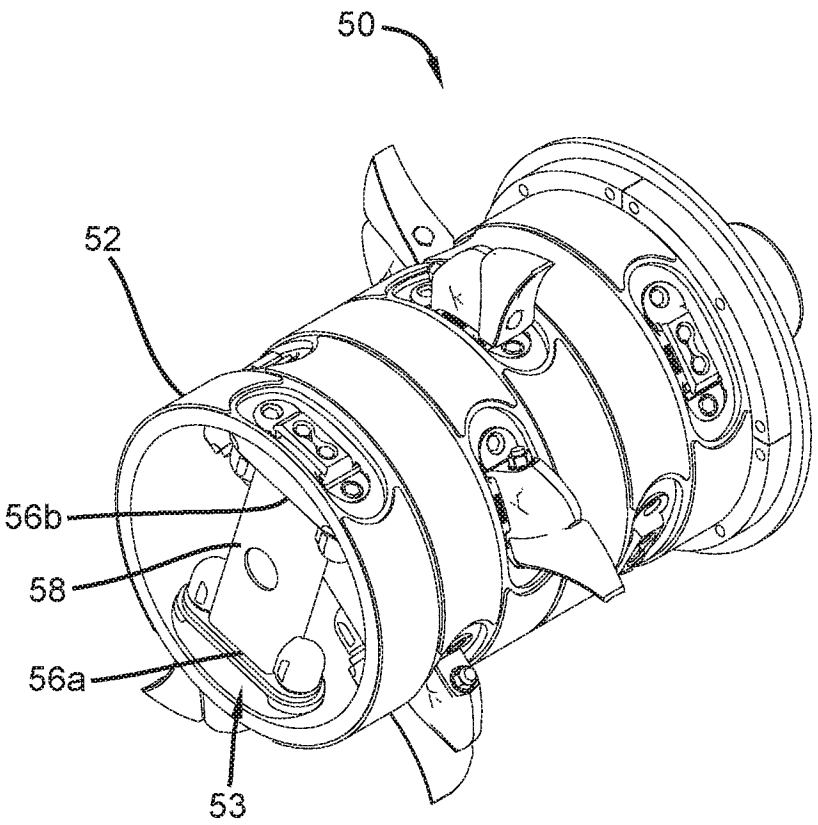
FIG. 12 is a perspective, cross-sectional view taken through section line 12-12 of FIG. 8 showing a hammer mounting structure having hammer receivers positioned on diametrically opposite sides of the rotor.
Figure 13:
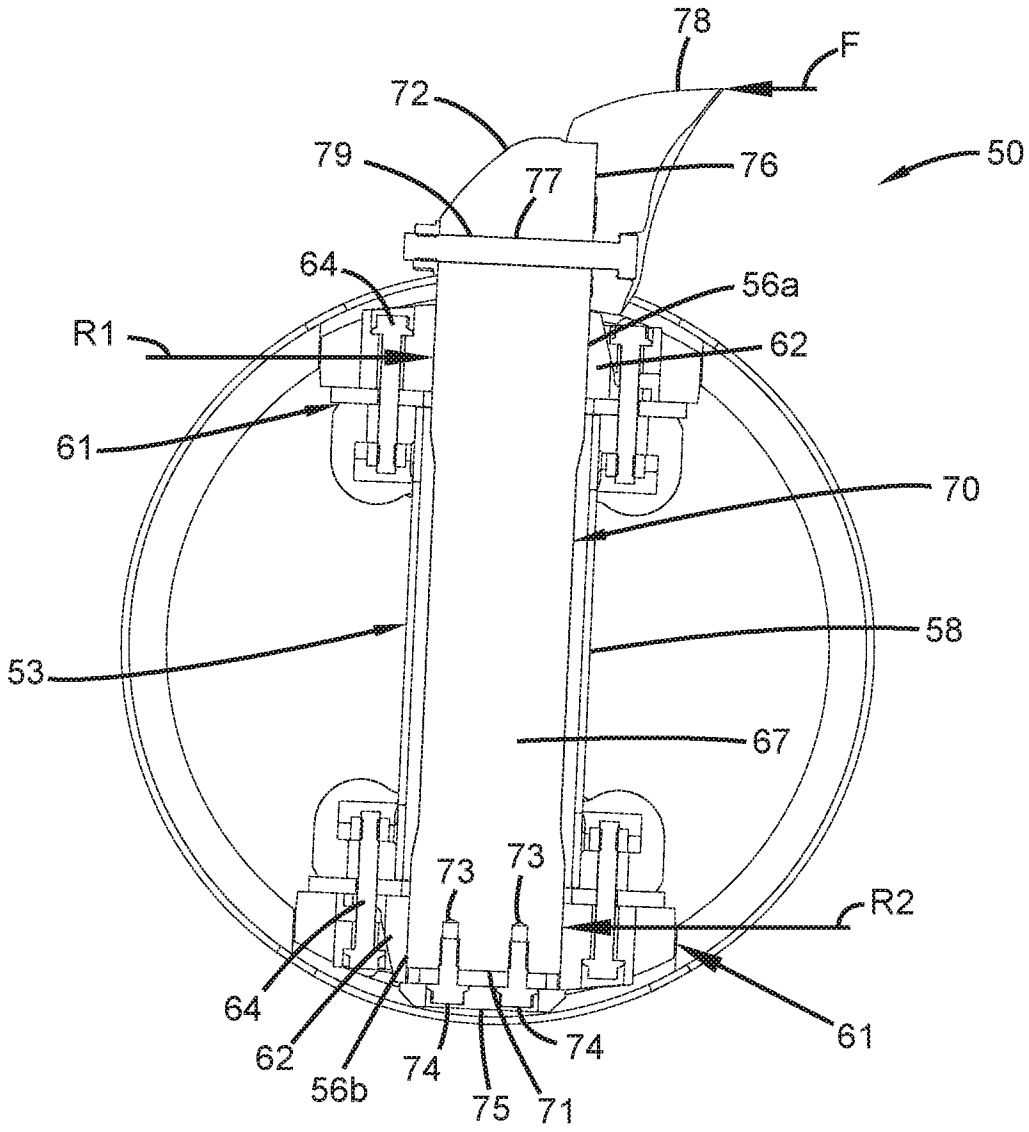
FIG. 13 is a cross-sectional view taken along section line 13-13 of FIG. 8 showing a single-reducer hammer secured within opposite hammer receivers of the rotor.

An example single-reducer hammer 70 is depicted in isolation from the rotor 52 at FIGS. 9-11. FIGS. 4-8 show the rotor 52 fully populated with the single-reducer hammers 70 and FIGS. 12 and 13 are cross-sectional views detailing how the single-reducer hammers 70 are secured to the rotor 52 at the component mounting locations 53. Referring to FIGS. 9-11, the single-reducer hammer 70 includes an elongate hammer body 67 (e.g., a bar) having a blank end 71 positioned opposite from a reducing end 72. As shown at FIGS. 12 and 13, the blank end 71 includes fastener openings 73 for receiving fasteners 74 used to secure a blank cap or blank cover 75 (see FIGS. 12 and 13) to the blank end 71 when the single-reducer hammer 70 is mounted to the rotor 52. The blank cover 71 assists in defining the blank location at the exterior of the rotor and provides a protective wear surface at the blank end of the hammer. If the cover 71 is pre-installed on the hammer prior to installation of the hammer, the cover can function as a positive stop when the hammer is slid into on the of the component mounting locations. As shown at FIGS. 12 and 13, the reducing end 72 includes a reducer mounting surface 76 and defines one or more fastener openings 77 for use in removeably attaching a reducer (e.g., a cutter 78) to the reducer mounting surface 76 by at least one fastener 79. When mounted at the component mounting location 53, the elongate hammer body 72 extends through the hammer receivers 56*a*, 56*b* and is clamped to the rotor 52 by the clamping arrangements 61 at the hammer receivers 56*a*, 56*b*. As so mounted, the reducing end 72 of the single-reducer hammer 70 defines a reducing location at the hammer receiver 56*a* and the blank end 71 defines a blank location at the hammer receiver 56*b*.

As depicted at FIG. 13, the reducing end 72 and the blank end 71 are both anchored to the rotor (e.g., via the clamps) at separate anchoring locations. The blank end 71 can be referred to as a secondary anchoring end and the reducing end 72 can be referred to as a primary anchoring end. The anchoring locations are spaced apart from one another and correspond with opposite ends of the hammer body 67. In one example, the anchoring locations are positioned on diametrically opposite sides of the rotor, and one of the anchoring locations does not include a corresponding reducer. As shown at FIG. 13, during shredding, a shredding force F is applied to the single-reducer hammer 70 at the reducer 78, a primary reaction force R1 is applied to the hammer 70 adjacent the reducing end of the hammer 70 at the primary anchoring location (i.e., the hammer receiver 56*a*) and an opposite secondary reaction force R2 is applied to the hammer 70 adjacent the blank end of the hammer at the secondary anchoring location (i.e., the hammer receiver 56*b*). The length of the hammer body 67 provides a lever arm that increases the effect of the secondary reaction force R2 in stabilizing/anchoring the hammer 70 thereby reducing the magnitude of the force R2 required to provide stabilization. In certain alternative examples, the hammer receiver 56*b* can include structure that defines a blind end for receiving the non-reducing end of the component; but that does not provides means for allowing a component to pass completely through the rotor at the blind end. The non-reducing end of the hammer can be secured to the structure defining the blind end by fasteners, clamps or other structures. This type of example would provide the reinforcing benefits associated with having separated component anchoring locations for supporting a single reducer location, but would not have the ability to receive both single-reducer and double-reducer hammers.

A double-reducer hammer is a hammer having two opposite ends that are reducing ends. Each reducing end can either itself form a reducer or reducers, or can provide an attachment location for attaching one or more reducers. When a double-reducer hammer is mounted at one of the component mounting locations 53, the reducing ends form reducer locations at separate regions of the component mounting location (e.g., at opposite sides of the rotor 52). The reducer locations preferably projects outwardly (e.g., in a radial direction relative to the central axis 54) beyond the exterior of the rotor 52.

Figure 14:
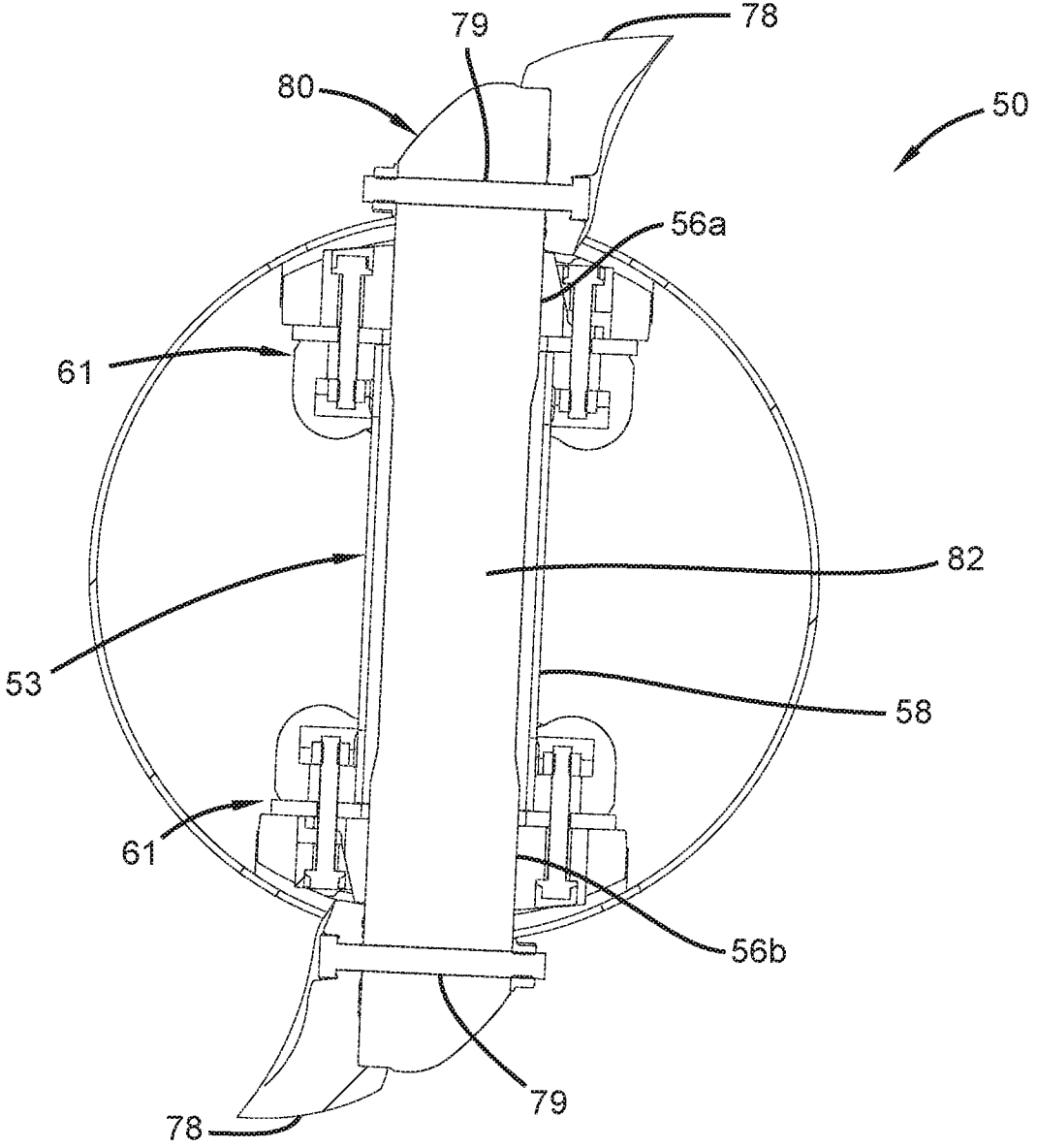
FIG. 14 is a cross-sectional view showing a double-reducer hammer mounted within opposite hammer receivers of the rotor of FIG. 8.

An example double-reducer hammer 80 is depicted in isolation from the rotor 52 at FIGS. 9-11. FIG. 14 is a cross-sectional view one of the double-reducer hammers 80 secured to the rotor 52 at one of the component mounting locations 53. Referring to FIGS. 9-11, the double-reducer hammer 80 includes an elongate hammer body 82 (e.g., a bar) having opposite reducing ends 72 at which cutters 78 are removeably attached via fasteners 79. The hammer body 82 is longer than the hammer body 72. When mounted at the component mounting location 53, the elongate hammer body 82 extends through the hammer receivers 56*a*, 56*b* and is clamped to the rotor 52 by the clamping arrangements 61 at the hammer receivers 56*a*, 56*b*. The reducing ends 72 project outwardly from the exterior of the rotor 52 at the hammer receivers 56*a*, 56*b*.

Figure 15:
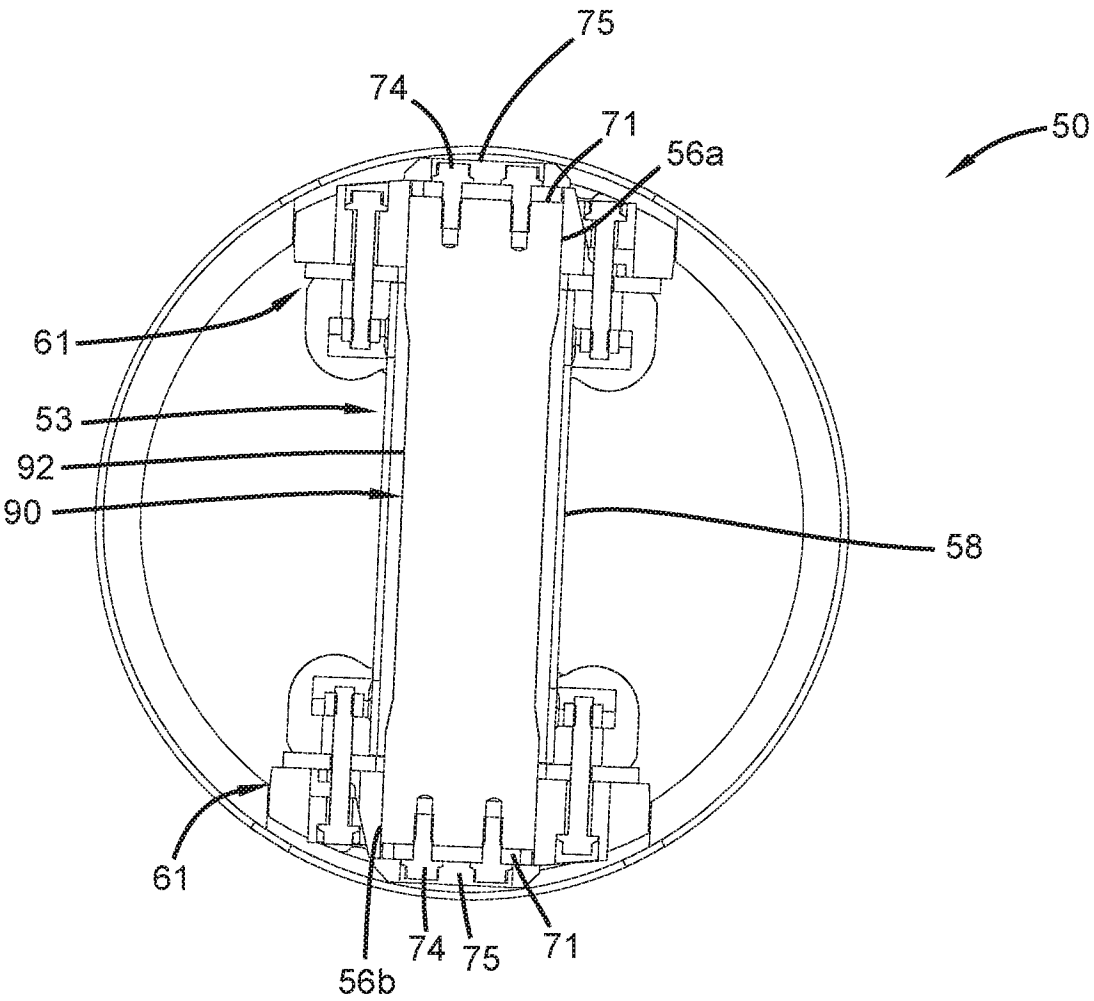
FIG. 15 is a cross-sectional view showing a double-blank component secured within opposite hammer receivers of the rotor of FIG. 8.

A double-blank component is a component having opposite ends that are blank end adapted to form blank locations at the exterior of the rotor when the double-blank is secured thereto. An example double-blank component 90 is depicted in isolation from the rotor 52 at FIGS. 9-11. FIG. 15 is a cross-sectional view one of the double-blank components 90 secured to the rotor 52 at one of the component mounting locations 53. Referring to FIGS. 9-11, the double-blank component hammer 90 includes an elongate component body 92 (e.g., a bar) having opposite blank ends 71. The component body 92 is shorter than the hammer body 72. When mounted at the component mounting location 53, the elongate component body 92 extends through the hammer receivers 56*a*, 56*b* and is clamped to the rotor 52 by the clamping arrangements 61 at the hammer receivers 56*a*, 56*b*. The blank ends 71 form blank locations at the hammer receivers 56*a*, 56*b*.

As indicated above, the components can be loaded into the rotor and removed from the rotor while the rotor remains mounted within the reducing box 22 of the reducing machine. This allows components to be interchanged without removing the rotor from the reducing machine. To access the component mounting locations, a side wall of the reducing box 22 can be pivoted down to expose one side of the rotor. A working platform can be provided by the reducing machine adjacent the open side. The rotor can be rotated to index the mounting locations into alignment with the open side. For example, to load a component into a component mounting location, the rotor can be rotated such that the hammer receiver 56*a* faces the open side of the reducing machine. A component can then be loaded into the component mounting location through the hammer receiver 56*a* and anchored to the rotor at the hammer receiver 56*a* (e.g., the hammer receiver 56*a* can be used to clamp one end of the component). The rotor can then be rotated 180 degrees such that the hammer receiver 56*b* faces the open side of the reducing machine to thereby provide access for anchoring the component at the hammer receiver 56*b* (e.g., the hammer receiver 56*b* is used to clamp an opposite end of the component). A reducer or blank plate can also be attached to the component at this time. To remove a component, the process is accomplished in reverse. The rotor is rotated such that the hammer receiver 56*b* faces the open side of the reducing machine to allow one end of the component to be released from the hammer receiver 56*b* (e.g., one end of the component is unclamped with respect to the hammer receiver 56*b*). A blank plate or a reducer can also be removed from the component at that time. The rotor is then rotated 180 degrees such that the hammer receiver 56*a* faces the open side of the reducing machine. The opposite end of the component is then released from the hammer receiver 56*a* (e.g., unclamped) thereby allowing the component to be slid out from the component mounting location of the rotor.

As described above, each component mounting location is depicted as including first and second hammer receivers 56*a*, 56*b* positioned on diametrically opposite sides of the rotor (e.g., the first and second hammer receivers are spaced about 180 degrees apart around the circumference of the rotor). Thus, when a component (e.g., a single-reducer hammer or a double-reducer hammer or a double-blank component) is mounted to the rotor at one of the mounting locations 53, the component extends through the rotor 52 and across the central rotor axis 54 generally through the entire rotor 52, and is secured to the rotor at two separate locations on opposite side of the rotor 52. In other examples, the first and second hammer receivers forming a given pair of hammer receivers can be positioned less than 180 degrees apart about the circumference of the rotor so that the hammers mount in more of a chord-like configuration and optionally do not intersect the central axis of the rotor.

Figure 4:
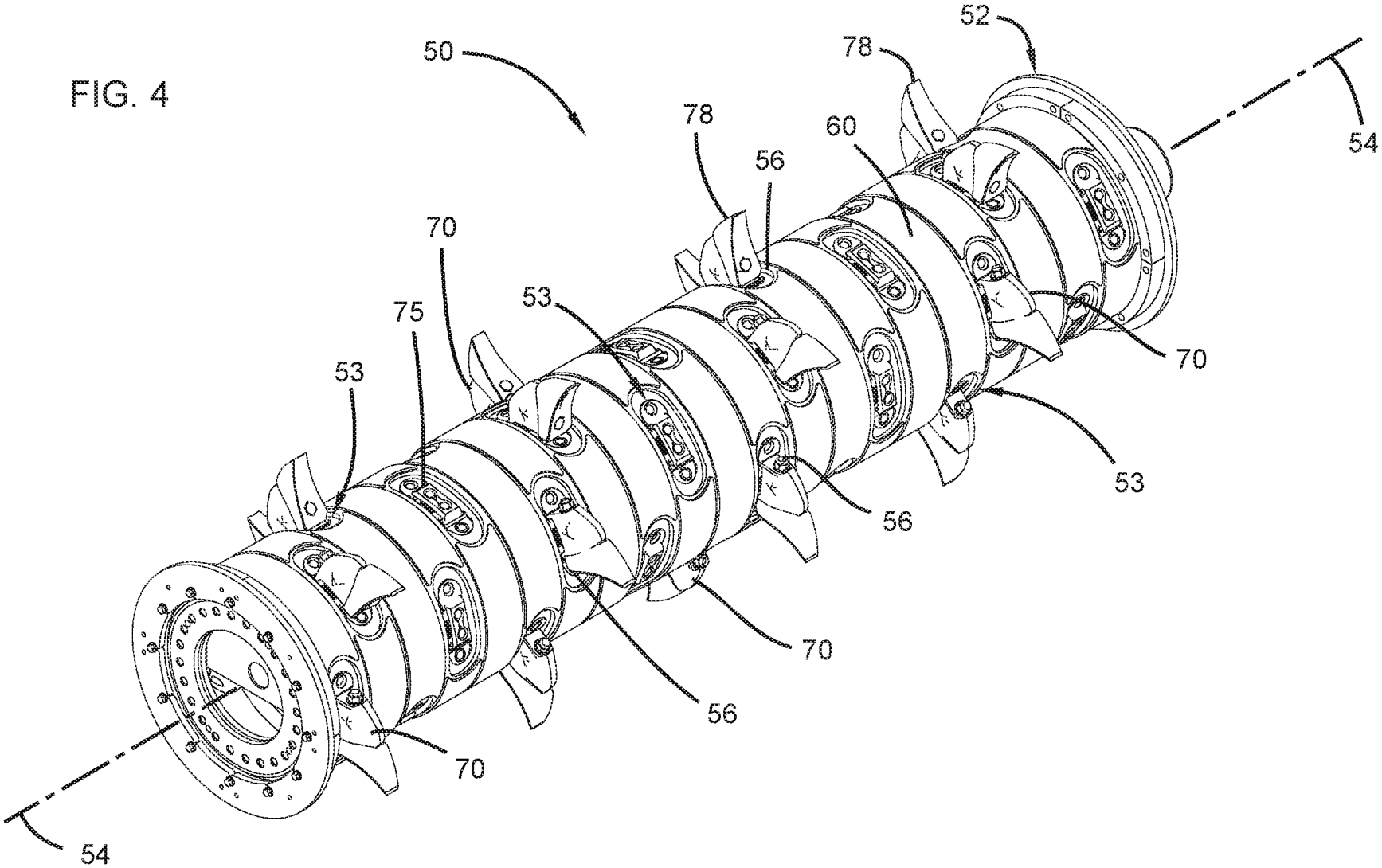
FIG. 4 is a perspective view of a reducing rotor system in accordance with the principles of the present disclosure.
Figure 5:
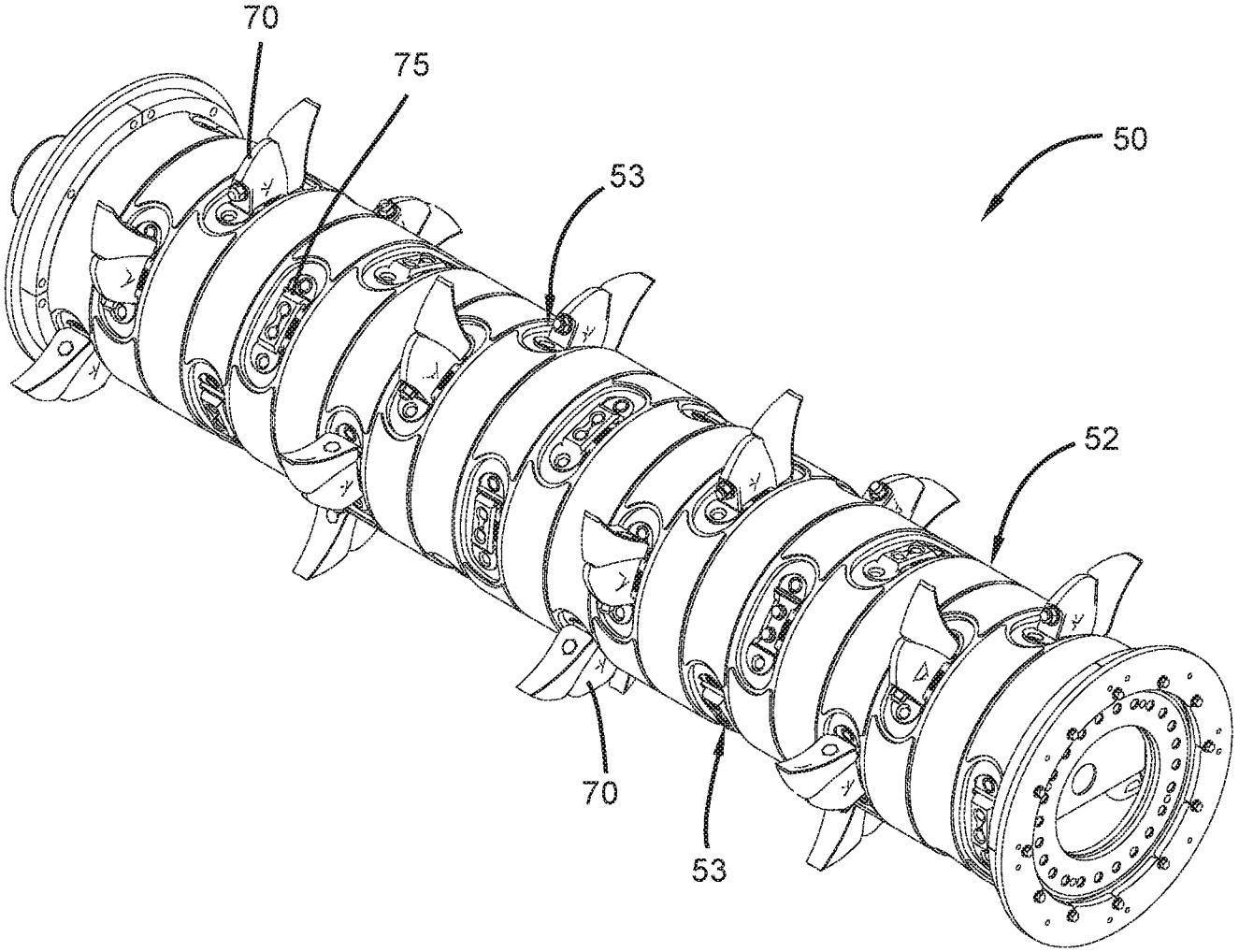
FIG. 5 is another perspective view of the reducer rotor system of FIG. 4.
Figure 6:
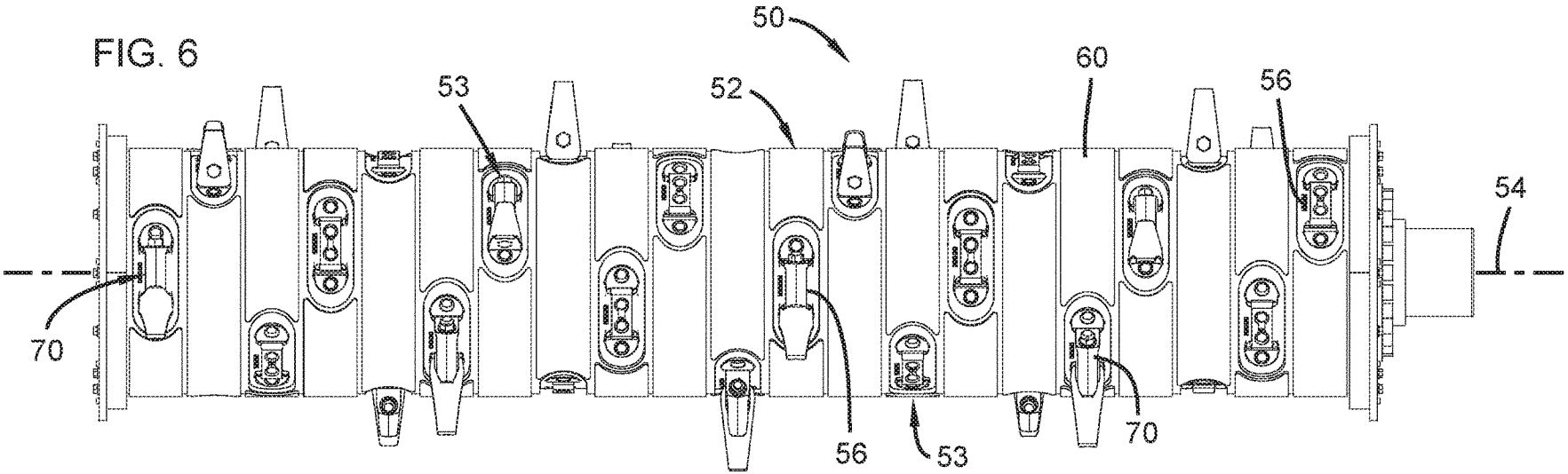
FIG. 6 is a front view of the reducer rotor system of FIG. 4.
Figure 7:
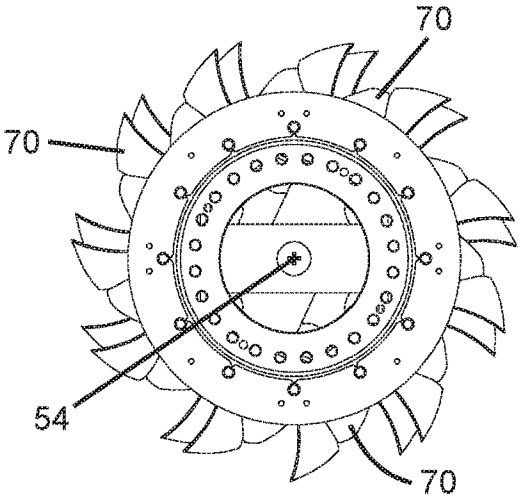
FIG. 7 is an end view of the reducer rotor system of FIG. 4.
Figure 8:
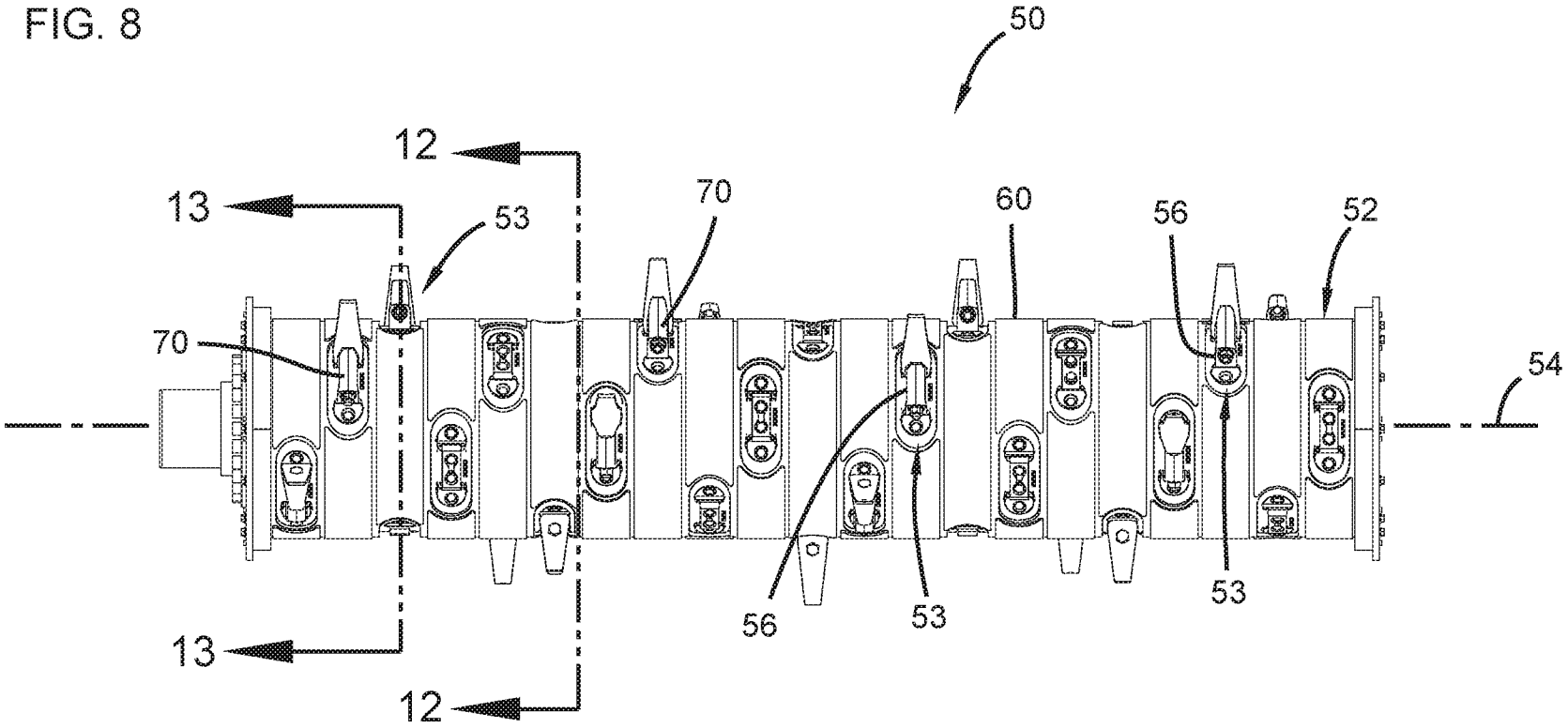
FIG. 8 is a rear view of the reducer rotor system of FIG. 4.

In the depicted example of FIG. 4, the hammers mount to the rotor in an orientation perpendicular relative to the central axis of rotation of the rotor. In other examples, the hammers can be skewed (e.g., oriented at non-perpendicular angles relative to the central axis of rotation of the rotor).

As depicted at FIG. 14, the same style of reducer is shown mounted at both ends of the double-reducer hammer. In other examples, different styles of reducer can be mounted at opposite ends of a given double-reducer hammer.

As depicted at FIG. 4, all of the single-reducer hammers are depicted having the same style of reducer. In other examples, single-reducer hammers having different styles of reducers can be used to populate a given rotor.

In the depicted system of FIGS. 4-15, each component mounting location corresponds to first and second separate locations at which a reducer location or a blank location can be defined. Whether the first and second locations are both occupied by reducers, both occupied by blanks or one occupied by a blank and one by a reducer is dependent on the type of component mounted at the component mounting location. By populating the component mounting locations with different types of components, the rotor 52 can be configured in different reducing configurations. A number of different reducing configurations in which the rotor can be configured are shown at FIGS. 16-21. In FIGS. 16-21, the rotor 52 is shown optionally having twenty-one component mounting locations 53 consecutively positioned axially along the length of the rotor 52. Of course, the number of component mounting locations can be varied from embodiment to embodiment. In FIGS. 16-21 the rotor 52 has been cut longitudinally and laid flat to provide a plan view in which the length L and the circumference C of the rotor 52 are fully visible. In FIGS. 16-21, a box filled with an X represents a reducer location and an open box represents a blank location.

Figure 16:
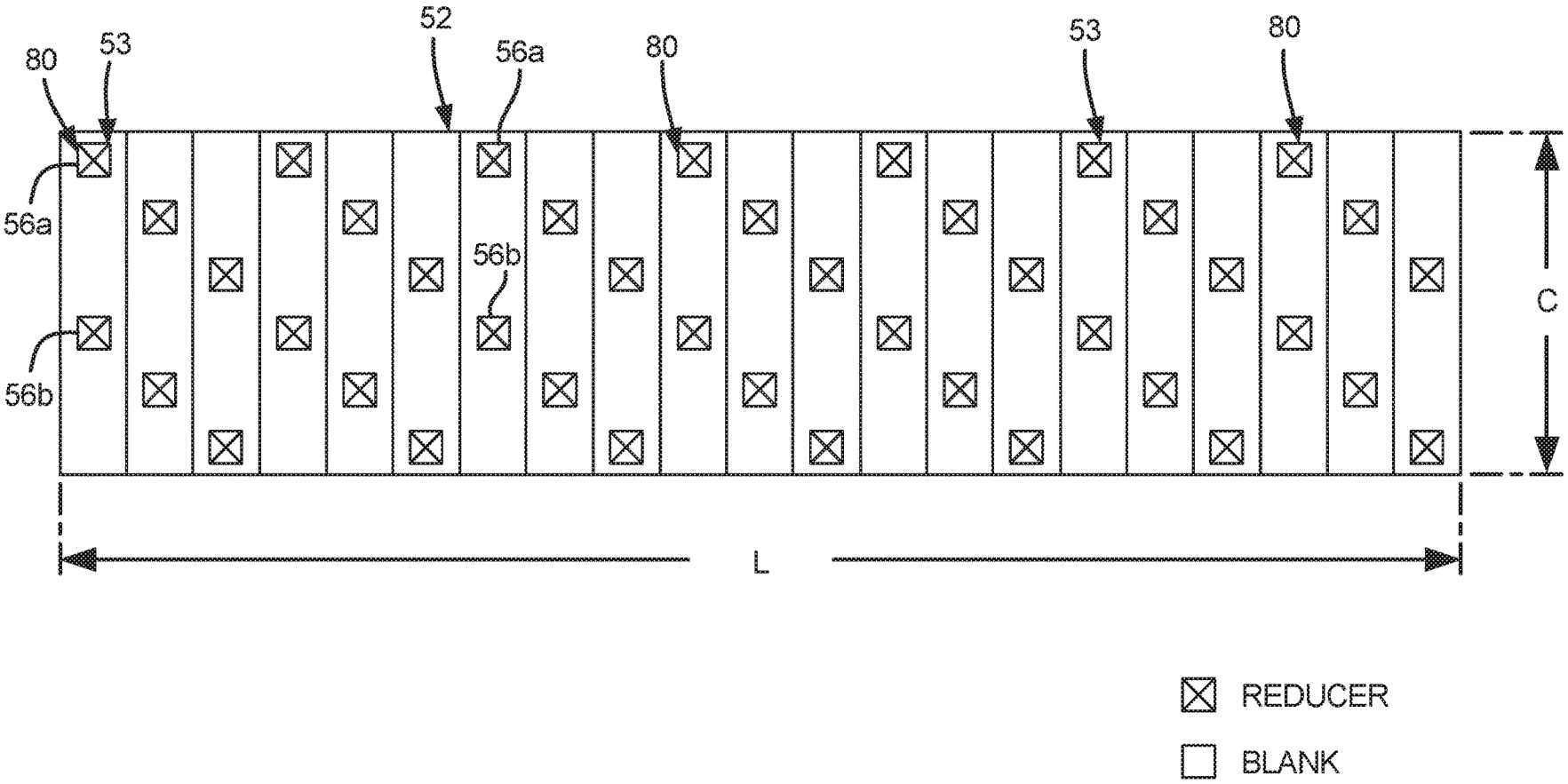
FIG. 16 is a longitudinally cut and laid flat view of the rotor of FIG. 8 arranged in a configuration in which all of the hammer receivers of the rotor are occupied by the ends of double-reducer hammers.

FIG. 16 represents a first configuration of the rotor 52 in which all of the component mounting locations 53 are populated with double-reducer hammers 80 and reducer locations are defined at all of the receivers 56*a*, 56*b* of the rotor 52. The first configuration has a first reducer density which represents the highest reducer density in which the rotor 52 can be configured. The reducer density can be reduced by interchanging one or more of the double-reducer hammers 80 with single-reducer hammers 70 or double-blank components 90. The components can be interchanged to arrange the blank locations and/or the reducer locations in patterns or to provide a random distribution of blank locations and/or reducer locations.

Figure 17:
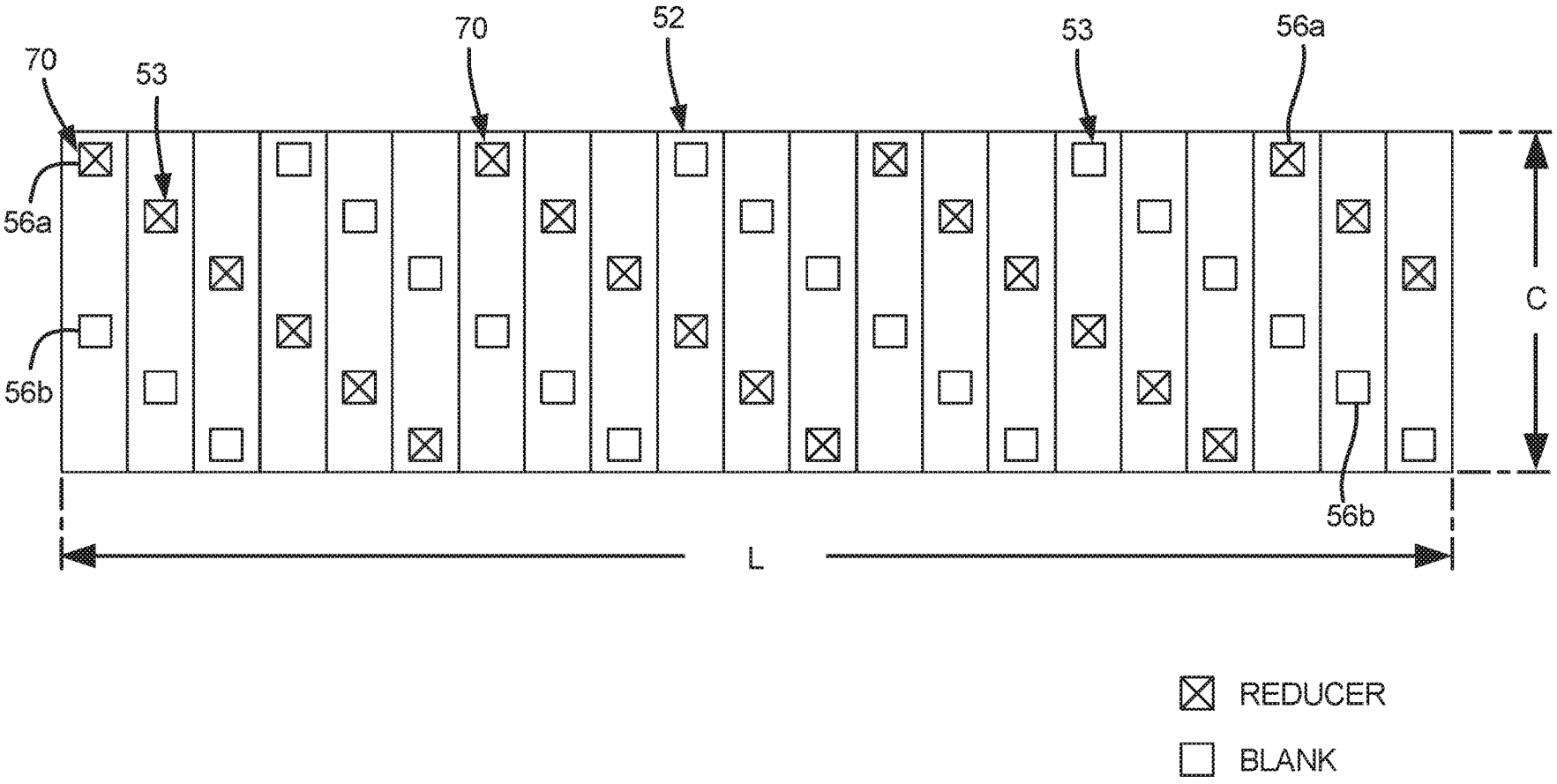
FIG. 17 is a longitudinally cut and laid flat view of the rotor of FIG. 8 arranged in a configuration in which the rotor fully populated with only single-reducer hammers such that half of the hammer receivers are securing reducers and the remaining half of the hammer receivers receive blank ends of the hammers.

FIG. 17 represents a second configuration of the rotor 52 in which all of the component mounting locations 53 are populated with single-reducer hammers 70. The hammers are arranged such that reducer locations are provided at all the first receivers 56*a* and blank locations are provided at all the second receivers 56*b*. The second configuration has a second reducer density that is half as dense as the first reducer density. In the second configuration, the single-reducer hammers 70 are oriented such that the reducer locations of adjacent component mounting locations are circumferentially offset by a uniform first circumferential offset angle that is relatively small (e.g., 60 degrees) such that the reducer locations cooperate to define a first helix pattern having a first helix angle A1 that is relatively low. Once again, selected ones of the single-reducer hammers 70 can be replaced with double-reducer hammers 80 or double-blank hammers 90 to modify the overall reducer density of the rotor 52 and to customize the reducer pattern, reducer distribution and/or the reducer density at localized regions of the rotor 52.

Figure 18:
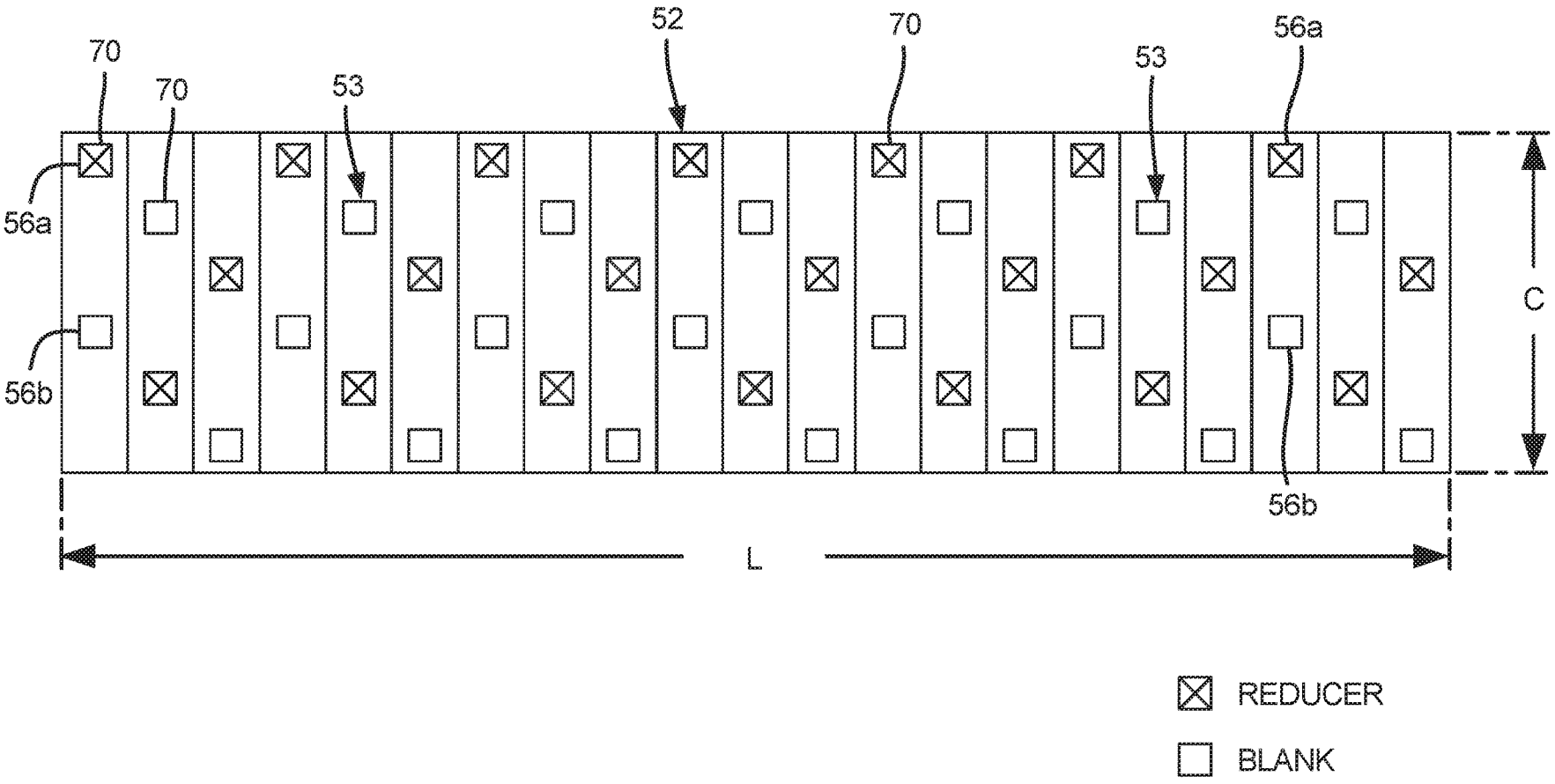
FIG. 18 is a longitudinally cut and laid flat view of the rotor of FIG. 8 arranged in a configuration in which the rotor fully populated with only single-reducer hammers and with the hammers being alternatingly flipped at adjacent axial sections of the rotor.

FIG. 18 represents a third configuration of the rotor 52 in which all of the component mounting locations 53 are populated with single-reducer hammers 70. The hammers are arranged such that reducer locations are alternately provided at the first receivers 56*a* and the second receivers 56*b* of the axially adjacent component mounting locations. The third configuration has the same reducer density as the second configuration. In the third configuration, the single-reducer hammers 70 are oriented such that the reducer locations of adjacent component mounting locations are circumferentially offset by a uniform second circumferential offset angle that is relatively large (e.g., 120 degrees) such that the reducer locations cooperate to define a second helix pattern having a second helix angle A2 that is relatively high. Once again, selected ones of the single-reducer hammers 70 can be replaced with double-reducer hammers 80 or double-blank hammers 90 to modify the overall reducer density of the rotor 52 and to customize the reducer pattern, reducer distribution and/or the reducer density at localized regions of the rotor 52.

Figure 19:
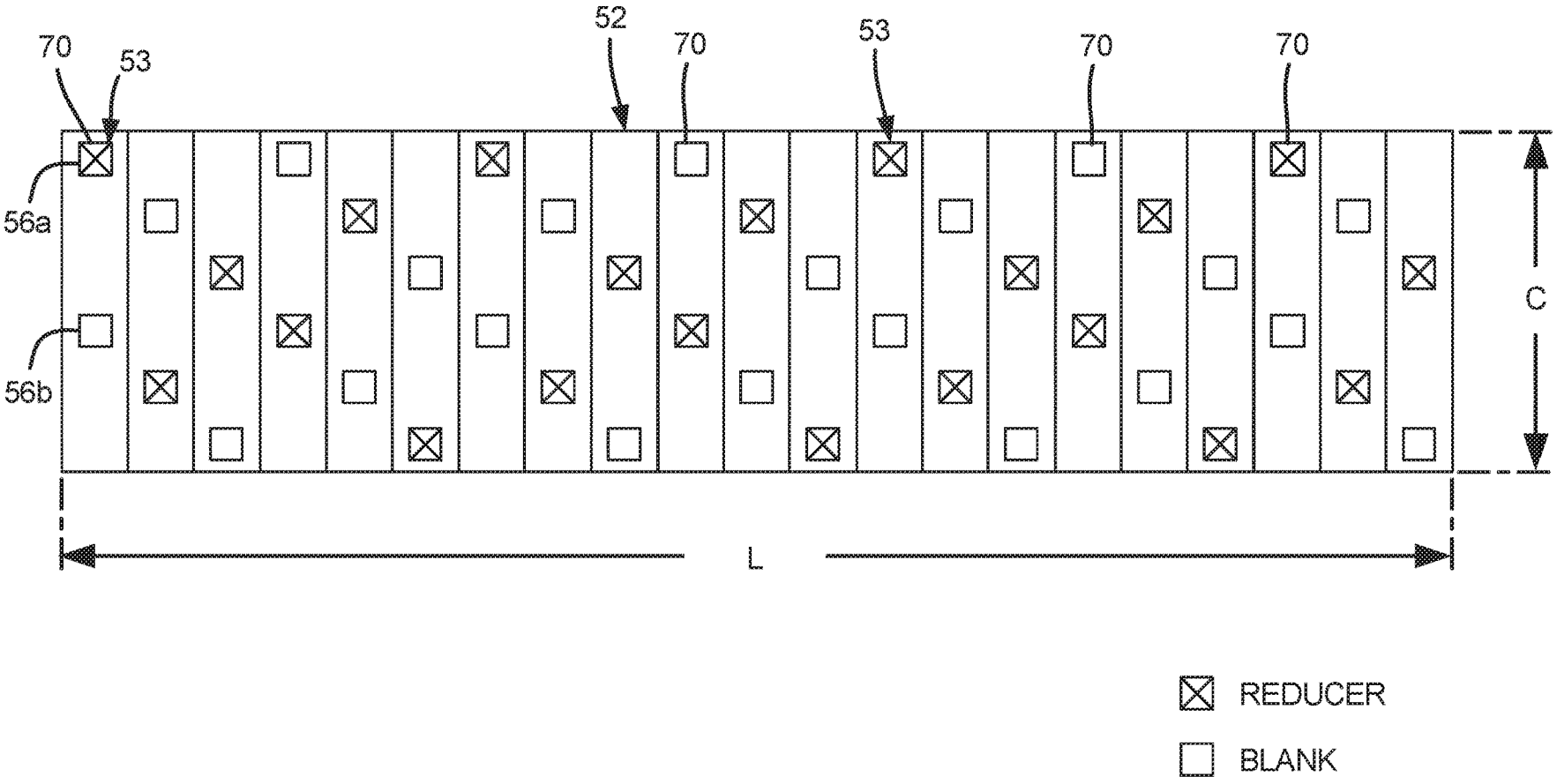
FIG. 19 is a longitudinally cut and laid flat view of the rotor of FIG. 8 arranged in a configuration in which the rotor fully populated with only single-reducer hammers with the single-rotor hammers being flipped at every third axial position along the length of the rotor.

FIG. 19 represents a fourth configuration of the rotor 52 in which all of the component mounting locations 53 are populated with single-reducer hammers 70. The hammers are arranged such that reducer locations are arranged in a pattern in which reducer locations are located at the first receivers 56*a* for two consecutive component mounting locations, and the reducer locations are located at the second receivers 56*b* every third component mounting locations. The fourth configuration has the same reducer density as the second and third configurations. In the fourth configuration, the single-reducer hammers 70 are oriented such that the reducer locations of adjacent component mounting locations are circumferentially offset by a circumferential offset angle that varies in size for each consecutive component mounting location (e.g., the offsets alternate between the first circumferential offset angle and the second circumferential offset angle. Once again, selected ones of the single-reducer hammers 70 can be replaced with double-reducer hammers 80 or double-blank hammers 90 to modify the overall reducer density of the rotor 52 and to customize the reducer pattern, reducer distribution and/or the reducer density at localized regions of the rotor 52.

Figure 20:
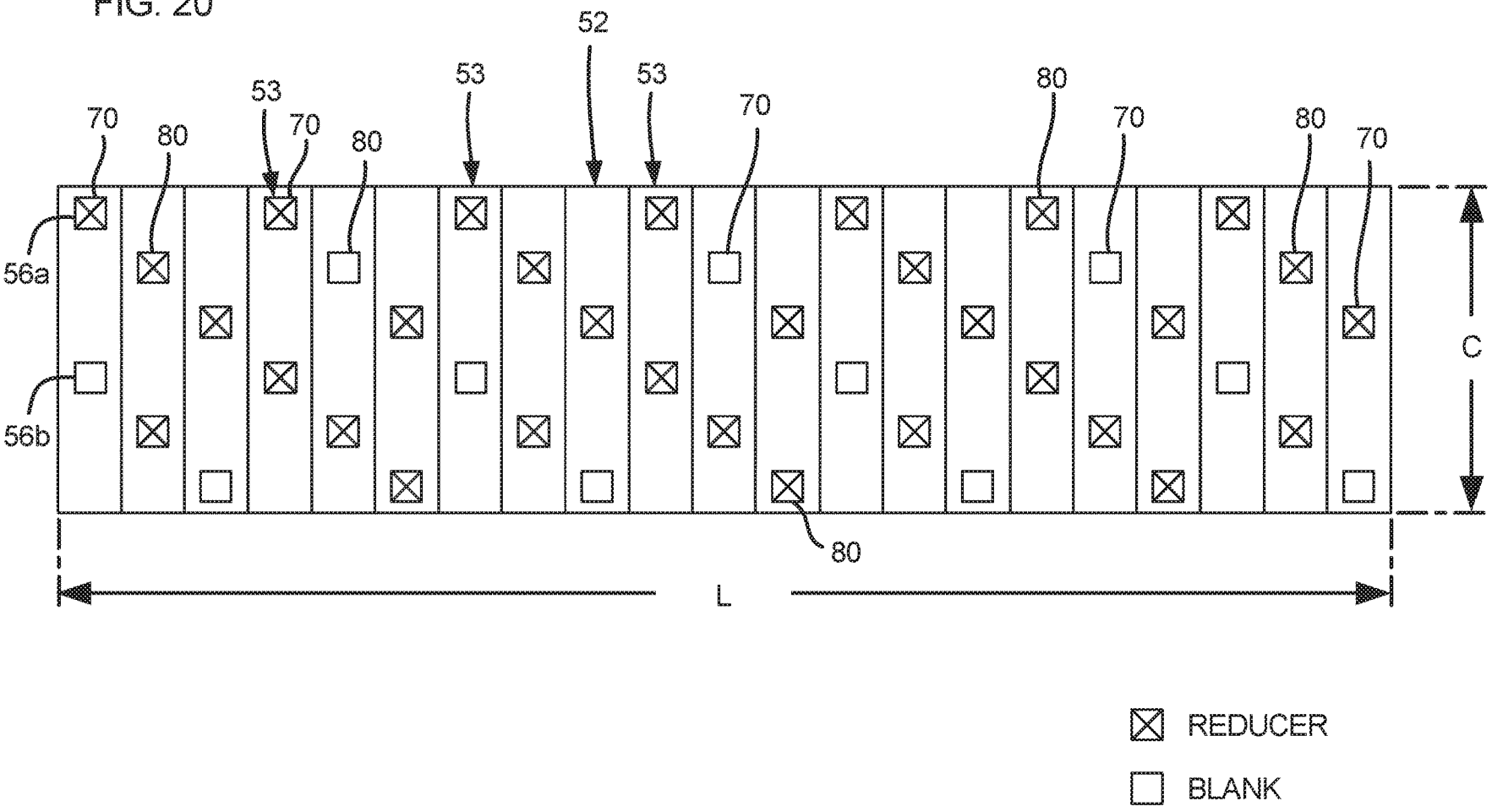
FIG. 20 is a longitudinally cut and laid flat view of the rotor of FIG. 8 arranged in a configuration with single-reducer hammers and double-reducer hammers being alternated at each adjacent axial region or section of the rotor.

FIG. 20 represents a fifth configuration of the rotor 52 in which the component mounting locations 53 are alternatingly populated with single-reducer hammers 70 and double-reducer hammer 80. The fifth configuration has a reducer density that is lower than the reducer density of the first configuration and higher than the reducer density of the second, third and fourth configurations. Once again, selected ones of the hammers can be replaced with single-reducer hammers, double-reducer hammers 80 or double-blank hammers 90 to modify the overall reducer density of the rotor 52 and to customize the reducer pattern, reducer distribution and/or the reducer density at localized regions of the rotor 52.

Figure 21:
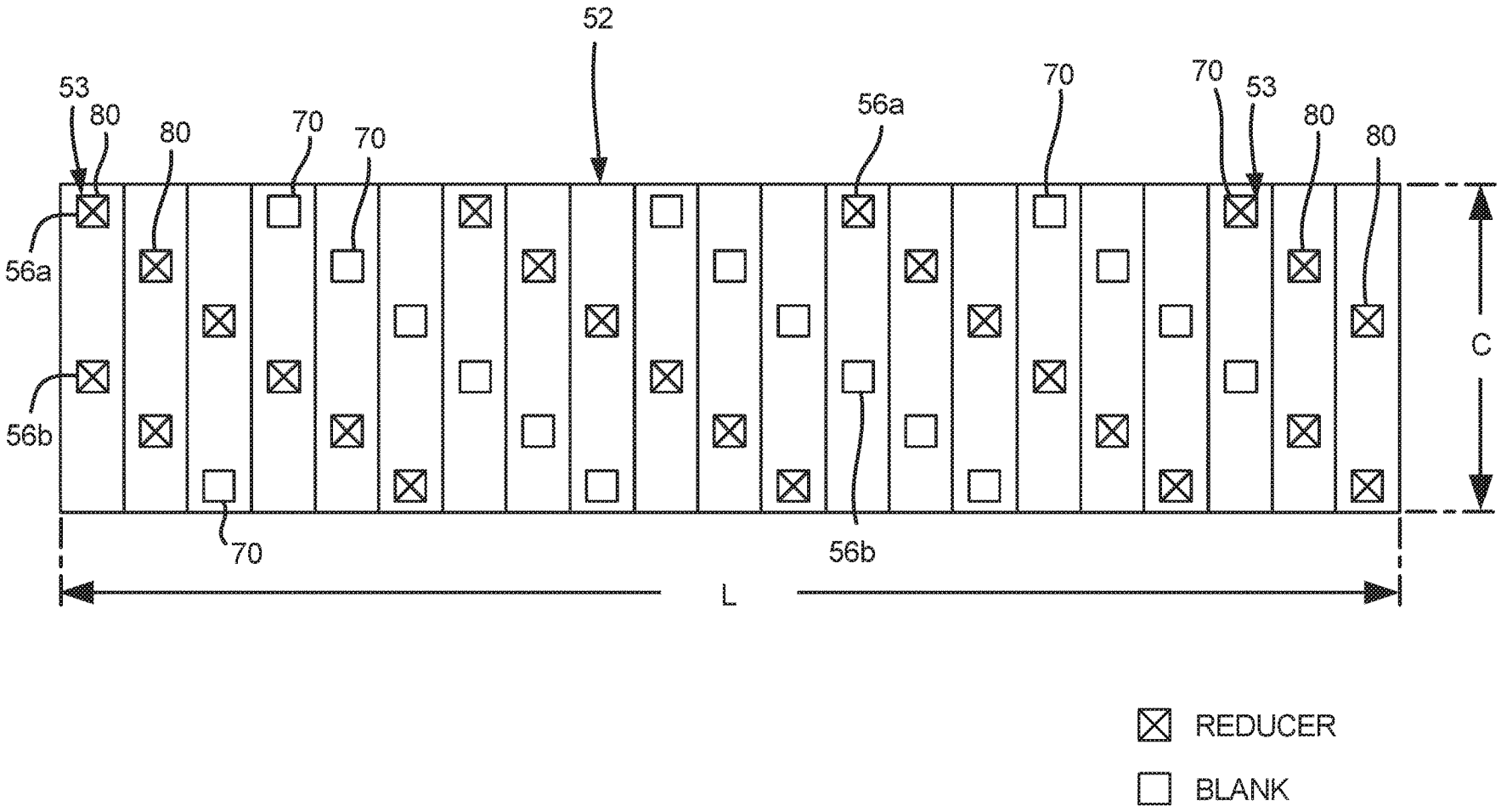
FIG. 21 is a longitudinally cut and laid flat view of the rotor of FIG. 8 arranged in a configuration with double-reducer hammers installed at the two outermost axial positions at opposite ends of the rotor and with single-reducer hammers installed at central sections of the rotor positioned between the end sections of the rotor.

FIG. 21 represents a sixth configuration of the rotor 52 in which a certain number of component mounting locations 53 at each end of the rotor 52 (e.g., two as depicted) are populated with double-reducer hammers 80 and the remainder of the component mounting locations 53 populated with single-reducer hammers 70. Once again, selected ones of the hammers can be replaced with single-reducer hammers, double-reducer hammers 80 or double-blank hammers 90 to modify the overall reducer density of the rotor 52 and to customize the reducer pattern, reducer distribution and/or the reducer density at localized regions of the rotor 52. In other examples, the central region of the rotor 52 may be populated with double-reducer hammers 80 and the end regions of the rotor 52 may be populated with single-reducer hammers 70. The localized regions having only single-reducer hammers 70 can be arranged in any of the patterns described above (e.g., see the patterns of FIGS. 17-19).

Figure 22:
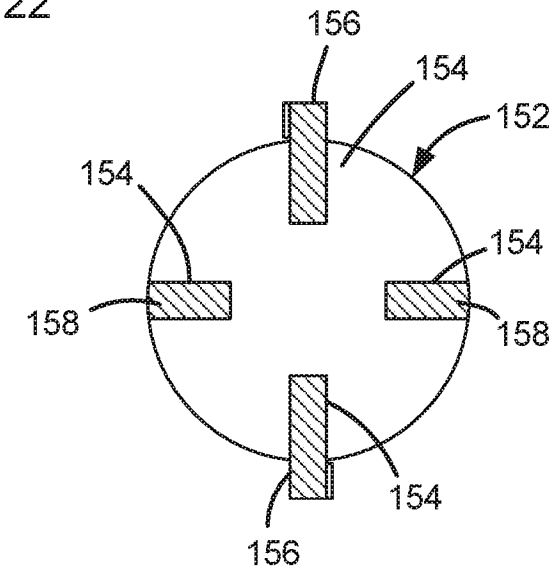
FIG. 22 schematically shows another rotor system in accordance with the principles of the present disclosure.

In other embodiments within the scope of the present disclosure, component mounting locations can each correspond to only one location at which a reducer location or a blank location can be defined. In such examples, the component mounting locations can be configured to receive components that do not extend a majority of the way through the rotor. In this type of configuration, when a first component type is mounted at a component mounting location of the rotor, the first component type defines only one reducer location at the exterior of the rotor and does not define any blank locations at the exterior of the rotor. The first component type can be referred to as a reducer component. In this type of configuration, when a second component type is mounted at a component mounting location of the rotor, the second component type defines only one blank location at the exterior of the rotor and does not define any reducer locations at the exterior of the rotor. The first component type can be referred to as a blank component. The components can be relatively short in length as comparted to the diameter of rotor since the components are not adapted to extend a majority of the way across the diameter of rotor. FIG. 22 depicts an example rotor 152 of this type having component mounting locations 154 for removeably and interchangeably mounting reducer components 156 and blank components 158. In one example, the component mounting locations 154 can be adapted to secure the components 156, 158 by clamping as disclosed by U.S. Pat. No. 9,675,976.

Definitions

A blank location is a location on a rotor that does not include a reducer and does not include structure projecting from the rotor for attaching a reducer.

A reducer location is a location on a rotor where at least one reducer is provided at an exterior of the rotor.

A reducing portion or a reducing end or a reducing component is a structure that when installed at a component mounting location of a rotor either: a) itself forms at least one reducer; or b) defines an attachment location for allowing at least one reducer to be attached thereto.

A blank end or a blank insert or a blank component or a blank is a structure that when installed at a component mounting location of a rotor forms a blank location at the component mounting location of the rotor.

A reducer is a structure for reducing material such as a cutter, a chisel, a grinding tip, a blade, a tooth, or like structures.

A reducer attachment is a reducer that can be removeably attached to an attachment location.

Removeably attached means attached in a way intended to facilitate removability of a part such as with fasteners or clamps as compared to a more permanent attachment technique such as welding.

What is claimed is:

1. A material reducing system comprising:

a rotor that in use is rotated about a central axis, the rotor including a plurality of component mounting locations;

a plurality of components that are removeably mountable at the component mounting locations and are configured for defining blank locations at an exterior of the rotor when mounted at the component mounting locations or are configured for defining reducer locations at the exterior of the rotor when mounted at the component mounting location, the plurality of components including:

single-reducer hammers each including a reducing end and an opposite blank end, wherein when each of the single-reducer hammers is mounted to the rotor at one of the component mounting locations, each single-reducer hammer extends through the rotor such that the reducing end defines one of the reducer locations at the exterior of the rotor and the blank end defines one of the blank locations at the exterior of the rotor opposite the reducing end.

2. The material reducing system of claim 1, wherein the component mounting locations include a plurality of hammer receivers, wherein the plurality of hammer receivers are arranged in pairs of first and second hammer receivers and each of the component mounting locations includes one of the pairs of first and second hammer receivers, wherein the first and second hammer receivers of each component mounting location cooperate to mount each of the single-reducer hammers to the rotor, and wherein when the single-reducer hammers are mounted to the rotor: a) the blank ends are received within the first hammer receivers of the component mounting locations; b) the reducing ends are received within second hammer receivers of the component mounting locations; c) the blank ends define the blank locations at the first hammer receivers; and d) the reducing ends project outwardly from the rotor and define the reducer locations at the second hammer receivers.

3. The material reducing system of claim 2, further including double-reducer hammers that are removeably mountable to the rotor at the component mounting locations and that are interchangeable with the single-reducer hammers, wherein the first and second hammer receivers of each component mounting location cooperate to mount each of the double-reducer hammers to the rotor such that each double-reducer hammer extends through the rotor, each double-reducer hammer including opposite first and second reducer ends that project oppositely from an exterior of the rotor and define reducer locations respectively at the first and second hammer receivers when the double-reducer hammer is mounted to the rotor.

4. The material reducing system of claim 3, wherein the rotor is configurable in a high density configuration by installing only double-reducer hammers on the rotor, and wherein the rotor is configurable in a low density configuration by installing only single-reducer hammers on the rotor.

5. The material reducing system of claim 4, wherein the low density configuration includes a steep helix angle variation or a shallow helix angle variation made possible by selectively flipping the single-reducer hammers.

6. The material reducing system of claim 3, wherein the rotor is configurable in an intermediate density configuration where a combination of the double-reducer hammers and the single-reducer hammers is installed on the rotor.

7. The material reducing system of claim 6, wherein the intermediate density configuration includes a variation in which the double-reducer hammers and the single-reducer hammers are alternatingly installed in axially adjacent ones of the hammer receivers and also includes a variation in which the double-reducer hammers are installed in axially outermost ones of the hammer receivers and the single-reducer hammers are installed in the hammer receivers positioned axially inside the axially outermost one of the hammer receivers.

8. The material reducing system of claim 2, further including double-blank components that are removeably mountable to the rotor at the component mounting locations, the double-blank components each having first and second opposite blank ends, wherein the first and second hammer receivers of each component mounting location cooperate to mount each of the double-blank components to the rotor such that each double-blank component extends through the rotor, the first and second opposite blank ends of each double-blank component defining blank locations on opposite sides of the rotor, respectively at the first and second hammer receivers when the double-blank component is mounted to the rotor.

9. The material reducing system of claim 2, wherein the first and second hammer receivers of each pair of hammer receivers are positioned on diametrically opposite sides of the central axis.

10. The material reducing system of claim 2, wherein the single-reducer hammers are perpendicularly oriented relative to the central axis when mounted to the rotor.

11. The material reducing system of claim 2, wherein the hammers are each clamped by two of the hammer receivers when mounted to the rotor.

12. The material reducing system of claim 2, wherein when the single-reducer hammers are mounted to the rotor, the blank ends are flush or recessed relative to an exterior of the rotor.

13. The material reducing system of claim 1, wherein the reducing ends of the single-reducer hammers define attachment locations for securing removeable reducer attachments at the reducer locations.

14. The material reducing system of claim 13, wherein the removeable reducer attachments are cutters.

15. The material reducing system of claim 1, wherein the rotor is installed in a shredder.

16. The material reducing system of claim 1, wherein the rotor mounts within a reducing machine, and wherein the components can be installed and/or interchanged while the rotor remains mounted within the reducing machine.

17. A material reducing apparatus comprising:

a rotor that in use is rotated about a central axis, the rotor including a plurality of hammer receivers;

interchangeable hammers that are removeably mountable to the rotor, the interchangeable hammers including double-reducer hammers and single-reducer hammers, wherein two of the hammer receivers cooperate to mount each of the single-reducer and double-reducer hammers to the rotor; and wherein the interchangeable single-reducer and double-reducer hammers allow the rotor to be configured in different reducing configurations; and wherein the double-reducer hammers each include first and second opposite reducing ends such that when mounted to the rotor, each double-reducer hammer extends through the rotor so that the first and second reducing ends project oppositely from an exterior of the rotor, and wherein the single-reducer hammers each include one reducing end and an opposite blank end such that when mounted to the rotor, each single-reducer hammer extends through the rotor so that the reducing end projects from the exterior of the rotor opposite the blank end.

18. The material reducing apparatus of claim 17, wherein the reducing ends that project from the exterior of the rotor define attachment locations for securing removeable reducer attachments to the reducing ends.

19. The material reducing apparatus of claim 18, wherein the removeable reducer attachments include cutters that are fastened to the attachment locations.

* * * * *